US011668444B2

(12) United States Patent
Yamaguchi

(10) Patent No.: US 11,668,444 B2
(45) Date of Patent: Jun. 6, 2023

(54) LIGHTING DEVICE AND VEHICLE LAMP FIXTURE

(71) Applicant: Stanley Electric Co., Ltd., Tokyo (JP)

(72) Inventor: Yuta Yamaguchi, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/794,564

(22) PCT Filed: Jan. 19, 2021

(86) PCT No.: PCT/JP2021/001624
§ 371 (c)(1),
(2) Date: Jul. 21, 2022

(87) PCT Pub. No.: WO2021/153338
PCT Pub. Date: Aug. 5, 2021

(65) Prior Publication Data

US 2023/0080181 A1 Mar. 16, 2023

(30) Foreign Application Priority Data

Jan. 30, 2020 (JP) ..... JP2020-013890

(51) Int. Cl.
*F21S 41/176* (2018.01)
*F21S 41/675* (2018.01)
(Continued)

(52) U.S. Cl.
CPC ..... *F21S 41/176* (2018.01); *F21S 41/16* (2018.01); *F21S 41/675* (2018.01); *F21V 9/30* (2018.02); *F21V 14/04* (2013.01)

(58) Field of Classification Search
CPC ..... F21S 41/16–176; F21S 41/675; F21V 9/30–45; F21V 14/04
See application file for complete search history.

(56) References Cited

U.S. PATENT DOCUMENTS 9,797,577 B2 * 10/2017 Harada ..... F21K 9/64
2015/0369440 A1 12/2015 Reinprecht et al.
(Continued)

FOREIGN PATENT DOCUMENTS

JP 2016-507135 A 3/2016
JP 2016-134357 A 7/2016
(Continued)

OTHER PUBLICATIONS

International Search Report and Written Opinion of the International Search Report for PCT/JP2021/001624 dated Mar. 23, 2021.

*Primary Examiner* — Jason M Han
(74) *Attorney, Agent, or Firm* — Kenealy Vaidya LLP

(57) ABSTRACT

A lighting device includes a laser light source configured to emit a laser beam, a wavelength conversion member including a laser beam irradiation region to which the laser beam is radiated and configured to emit a wavelength converted light excited by radiation of the laser beam, a laser beam scanning mechanism configured to form a light distribution pattern according to a scanning range of the laser beam by scanning the laser beam radiated to the laser beam irradiation region, and a projection lens configured to project illumination light that forms a light distribution pattern forward, and an incidence angle of the laser beam, which is scanned by the laser beam scanning mechanism, with respect to the wavelength conversion member is set to an angle where the laser beam does not directly enter the projection lens when the wavelength conversion member is damaged, chipped or fallen off.

9 Claims, 16 Drawing Sheets

(51) Int. Cl.

| | |
|---|---|
| ***F21V 14/04*** | (2006.01) |
| ***F21V 9/30*** | (2018.01) |
| ***F21S 41/16*** | (2018.01) |

(56) References Cited

U.S. PATENT DOCUMENTS

| | | | |
|---|---|---|---|
| 2016/0153632 | A1 | 6/2016 | Mitterlehner |
| 2016/0215947 | A1 | 7/2016 | Matsuno |
| 2019/0390831 | A1 | 12/2019 | Yamaguchi |

FOREIGN PATENT DOCUMENTS

| | | | |
|---|---|---|---|
| JP | 2016-528671 | A | 9/2016 |
| JP | 2017-191760 | A | 10/2017 |
| JP | 6312484 | B2 | 4/2018 |
| JP | 2018-106825 | A | 7/2018 |
| JP | 2019-220605 | A | 12/2019 |
| JP | 2020-004517 | A | 1/2020 |
| WO | 2021/153338 | A1 | 8/2021 |

* cited by examiner

LIGHTING DEVICE AND VEHICLE LAMP FIXTURE

This application is a U.S. National Stage Application under 35 U.S.C § 371 of International Patent Application No. PCT/JP2021/001624 filed Jan. 19, 2021, which claims the benefit of priority to Japanese Patent Application No. 2020-013890 filed Jan. 30, 2020, the disclosures of all of which are hereby incorporated by reference in their entireties.

TECHNICAL FIELD

The present invention relates to a lighting device, and a vehicle lamp fixture including such a lighting device.

Priority is claimed on Japanese Patent Application No. 2020-013890, filed Jan. 30, 2020, the content of which is incorporated herein by reference.

BACKGROUND ART

In recent years, illumination light has been obtained by irradiating a phosphor plate (a wavelength conversion member) with a laser beam emitted from a laser light source such as a laser diode (LD) or the like, by which high brightness and high output light is obtained.

In such a lighting device, by combining a laser light source configured to emit a blue laser beam and a phosphor plate configured to emit wavelength converted yellow light (fluorescent light) excited by the blue laser beam (exciting light), white light (illumination light) can be obtained through color mixing of this blue light and yellow light.

In addition, a vehicle lamp fixture to which such a lighting device is applied is known. In the vehicle lamp fixture, the lighting device is used in a headlight (headlamp) for a vehicle configured to project illumination light that forms a light distribution pattern for a low beam including a cutoff line on an upper end thereof as a passing beam (low beam) and illumination light that forms a light distribution pattern for a high beam above the light distribution pattern for the low beam as a traveling beam (high beam) toward a side in front of the vehicle using a projection lens.

Specifically, in the vehicle lamp fixture, the light distribution pattern according to a scanning range of a laser beam is formed by providing a laser beam irradiation region corresponding to each of the light distribution pattern of each of the above-mentioned light distribution pattern for a low beam, a light distribution pattern for a high beam, and the like, in a surface of a phosphor plate, and by scanning the laser beam radiated to the laser beam irradiation region using a laser beam scanning mechanism such as a micro-electro-mechanical systems (MEMS) mirror or the like (for example, see Patent Literature 1).

Further, in such a vehicle lamp fixture, it is also possible to provide a light distribution variable headlamp (adaptive driving beam (ADB)) configured to variably control a light distribution pattern of light projected toward a side in front of the vehicle through scanning of the laser beam. The ADB is a technology of recognizing a preceding car, an oncoming car, a pedestrian, or the like, using an in-vehicle camera, and enlarging a visual field in front of a driver at nighttime without imparting glare to a driver or a pedestrian in front of the driver.

CITATION LIST

Patent Literature

[Patent Literature 1]
Japanese Patent No. 6312484

SUMMARY OF INVENTION

Technical Problem

Incidentally, in the above-mentioned lighting device, a laser beam with high light intensity is scanned in a surface of the phosphor plate. In addition, the laser beam radiated on the phosphor plate is diffused by phosphor particles dispersed in the phosphor plate. For this reason, since the light intensity per unit area of the light emitted from the phosphor plate becomes low and becomes non-coherent light, it becomes illumination light that is safe for the eyes.

Meanwhile, a temperature distribution in the surface of the phosphor plate is generated through scanning of the laser beam. In addition, in the case of the vehicle lamp fixture, since it is exposed to external air, it is also affected by an external air temperature. The vehicle lamp fixture may undergo, for example, a temperature change from −40° C. to over +100° C.

Accordingly, a mechanical external force such as distortion or the like due to a temperature change is applied to the phosphor plate. In addition, in the case of the vehicle lamp fixture, an external force such as vibrations, an impact, or the like, from the vehicle is applied to the phosphor plate. Due to the influence of these external forces, not only damages or defects such as breaks, chips, cracks, pinholes, or the like, may occur in the phosphor plate, but also there is a possibility that the phosphor plate may fall out.

When damage, chips, or falling off occurs in the phosphor plate, the laser beam may be emitted directly to the outside through the projection lens. In this case, since it is dangerous if the laser beam enters the human eye directly, a mechanism configured to detect falling off of the phosphor plate is provided, and the laser light source is turned off (OFF) when the phosphor plate falls off.

However, in the mechanism configured to detect falling off of the phosphor plate, it is impossible to detect flaws or damage such as minute cracks, pinholes, or the like, generated in the phosphor plate. For this reason, the laser beam may be emitted directly to the outside through the projection lens.

An aspect of the present invention provides a lighting device that prevents a laser beam from being emitted directly to the outside through a projection lens even when flaws, damage, or falling off occurs in a wavelength conversion member, and a vehicle lamp fixture including such a lighting device.

Solution to Problem

An aspect of the present invention provides the following configurations.

(1) A lighting device including:

a laser light source configured to emit a laser beam;

a wavelength conversion member that includes a laser beam irradiation region to which the laser beam is radiated and that is configured to emit a wavelength converted light excited by radiation of the laser beam;

a laser beam scanning mechanism configured to form a light distribution pattern according to a scanning range of the laser beam by scanning the laser beam radiated to the laser beam irradiation region; and a projection lens configured to project illumination light that forms the light distribution pattern forward, wherein an incidence angle of the laser beam, which is scanned by the laser beam scanning mechanism, with respect to the wavelength conversion member is set to an angle where the laser beam does not directly enter the projection lens when the wavelength conversion member is damaged, chipped or fallen off.

(2) The lighting device according to the above-mentioned (1), wherein, when the wavelength conversion member is seen in a plan view, a center of a scanning range of the laser beam is located at a side opposite to a side where the laser beam scanning mechanism is disposed with respect to a center of the laser beam irradiation region.

(3) The lighting device according to the above-mentioned (2), wherein the laser light source and the laser scanning mechanism are disposed on one side and other side with respect to the wavelength conversion member, respectively, the laser beam scanning mechanism disposed on the one side forms a light distribution pattern according to a scanning range of one laser beam by scanning the one laser beam radiated toward the laser beam irradiation region from the laser light source disposed on the one side, the laser beam scanning mechanism disposed on the other side forms a light distribution pattern according to a scanning range of other laser beam by scanning the other laser beam radiated toward the laser beam irradiation region from the laser light source disposed on the other side, one synthesis light distribution pattern is formed by overlapping the light distribution pattern according to the scanning range of the one laser beam and the light distribution pattern according to the scanning range of the other laser beam, and wherein, when the wavelength conversion member is seen in a plan view, a center of scanning range of the one laser beam is located at a side opposite to a side where the laser beam scanning mechanism on the one side is disposed with respect to the center of the laser beam irradiation region, and a center of the scanning range of the other laser beam is located at a side opposite to a side where the laser beam scanning mechanism on the other side is disposed with respect to the center of the laser beam irradiation region.

(4) The lighting device according to the above-mentioned (3), wherein the one side is a position corresponding to a left side of the light distribution pattern, and the other side is a position corresponding to a right side of the light distribution pattern.

(5) The lighting device according to the above-mentioned (4), wherein, when the wavelength conversion member is seen in a plan view, a width of the laser beam irradiation region, which corresponds to a leftward/rightward direction of the light distribution pattern, is greater than a height of the laser beam irradiation region, which corresponds to an upward/downward direction of the light distribution pattern.

(6) The lighting device according to the above-mentioned (5), wherein the laser light source and the laser scanning mechanism are additionally disposed at positions corresponding to an upper side or a lower side of the light distribution pattern with respect to the wavelength conversion member, or disposed at positions corresponding to the upper side and the lower side of the light distribution pattern with respect to the wavelength conversion member, the laser beam scanning mechanism disposed on an additional side forms a light distribution pattern according to a scanning range of an added laser beam radiated toward the laser beam irradiation region from the laser light source disposed on the additional side by scanning the added laser beam, and one synthesis light distribution pattern is formed by overlapping the light distribution pattern according to the scanning range of the one laser beam, the light distribution pattern according to the scanning range of the other laser beam, and the light distribution pattern according to the scanning range of the added laser beam.

(7) The lighting device according to the above-mentioned (6), wherein, when the wavelength conversion member is seen in a plan view, a center of a scanning range of the added laser beam is located at an intersection between a vertical line corresponding to the upward/downward direction of the light distribution pattern passing through a center of the laser beam scanning mechanism on the additional side and a horizontal line corresponding to the leftward/rightward direction of the light distribution pattern which passes through the center of the laser beam irradiation region.

(8) The lighting device according to the above-mentioned (6) or (7), wherein the laser scanning mechanism disposed on the additional side is disposed to be deviated to either one of the one side corresponding to the left side of the light distribution pattern and the other side corresponding to the right side of the light distribution pattern.

(9) A vehicle lamp fixture including the lighting device according to either one of the above-mentioned (1) to (8).

Advantageous Effects of Invention

According to the aspect of the present invention, it is possible to provide a lighting device that prevents a laser beam from being emitted directly to the outside through a projection lens even when flaws, damage, or falling off occurs in a wavelength conversion member, and a vehicle lamp fixture including such a lighting device.

DESCRIPTION OF EMBODIMENTS

Figure 1:
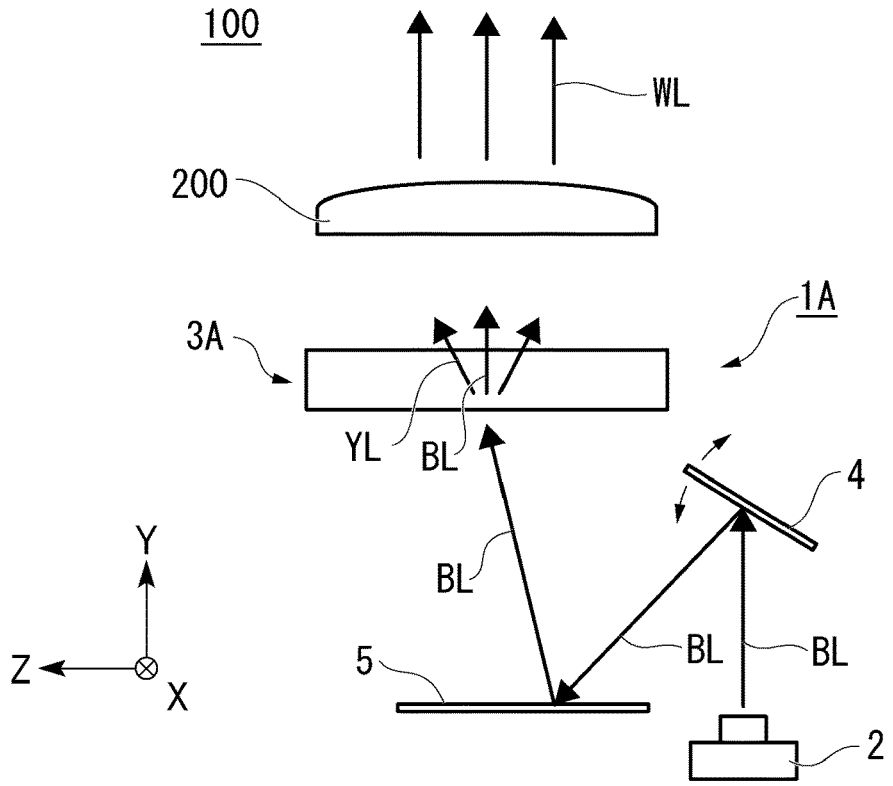
FIG. 1 is a schematic diagram representing a configuration of a vehicle lamp fixture including a transmission type lighting device according to a first embodiment of the present invention.

Hereinafter, embodiments of the present invention will be described with reference to the accompanying drawings.

Further, in the drawings used in the following description, in order to make components easier to see, scales of dimensions may be shown differently depending on the components, and dimensional ratios of each of the components may not be the same as the actual ones.

First Embodiment

First, a vehicle lamp fixture 100 including lighting devices 1A and 1B according to a first embodiment of the present invention will be described with reference to FIG. 1 and FIG. 2.

Further, FIG. 1 is a schematic diagram showing a configuration of the vehicle lamp fixture 100 including the lighting device 1A that is a transmission type. FIG. 2 is a schematic diagram showing a configuration of the vehicle lamp fixture 100 including the lighting device 1B that is a reflection type.

In addition, in the drawings described below, an XYZ orthogonal coordinate system is set, an X-axis direction represents a forward/rearward direction in the lighting devices 1A and 1B (the vehicle lamp fixture 100), a Y-axis direction represents a leftward/rightward direction of the lighting devices 1A and 1B (the vehicle lamp fixture 100), and a Z-axis direction represents an upward/downward direction of the lighting devices 1A and 1B (the vehicle lamp fixture 100).

(Transmission Type Lighting Device)

As shown in FIG. 1, for example, the lighting device 1A of the embodiment is obtained by applying the present invention to a headlight (headlamp) for a vehicle configured to radiate illumination light W toward a side in front of the vehicle (a +X-axis direction) as the vehicle lamp fixture 100 mounted on the vehicle.

Further, in the following description, directions of "forward," "rearward," "leftward," "rightward," "upward" and "downward," in the following description are not limited unless the context clearly indicates otherwise, and mean directions when viewing the front surface of the vehicle lamp fixture 100 (from a side in front of the vehicle).

The lighting device 1A constitutes the vehicle lamp fixture 100 including a projection lens 200 configured to project the illumination light WL to a side in front of the vehicle by being accommodated in a lighting body (not shown) together with the projection lens 200.

Specifically, the lighting device 1A generally includes a laser light source 2 configured to emit a laser beam BL that is exciting light, a transmission type wavelength conversion member 3A configured to emit wavelength converted fluorescent light YL excited by radiation of the laser beam BL, a laser beam scanning mechanism 4 configured to scan the laser beam BL radiated toward the wavelength conversion member 3A, and a reflector 5 configured to reflect the laser beam BL scanned by the laser beam scanning mechanism 4 toward the wavelength conversion member 3A.

The laser light source 2 is constituted by a laser diode (LD) configured to emit, for example, a blue laser beam (an emission wavelength is about 450 nm) as the laser beam BL. Further, the laser light source 2 may use the LD configured to emit an ultraviolet laser beam as the laser beam BL.

The wavelength conversion member 3A is constituted by a phosphor plate containing yellow phosphor particles excited by radiation of the laser beam BL to emit yellow light as the fluorescent light YL. In the embodiment, a member containing phosphor particles constituted by a composite (sintered compact) of YAG, into which an activator such as cerium Ce or the like is introduced, and alumina $Al_2O_3$, is used as the wavelength conversion member 3A. Further, the wavelength conversion member 3A may have a configuration in which a diffusing agent is contained in order to control light distribution characteristics of the illumination light WL emitted from the lighting device 1A, in addition to the phosphor particles.

The laser beam scanning mechanism 4 is constituted by a MEMS mirror disposed in an optical path between the laser light source 2 and the wavelength conversion member 3A. The MEMS mirror is a movable mirror using a MEMS technology, and controls a scanning direction and a scanning speed of the laser beam BL scanned in the surface of the wavelength conversion member 3A.

The reflector 5 is constituted by a planar mirror disposed in an optical path between the wavelength conversion member 3A and the laser beam scanning mechanism 4. The reflector 5 reflects the laser beam BL reflected by the MEMS mirror toward a back surface of the wavelength conversion member 3A.

In the lighting device 1A of the embodiment, the laser beam (blue light) BL radiated toward the back surface of the wavelength conversion member 3A passes through the wavelength conversion member 3A while being partially diffused therein, and the phosphor particles in the wavelength conversion member 3A are excited by irradiation with the laser beam BL, and fluorescent light (yellow light) YL is emitted, and thereby, illumination light (white light) WL can be emitted toward the projection lens 200 on the side in front due to color mixing of this blue light and yellow light radiation of the laser beam.

(Reflection Type Lighting Device)

Figure 2:
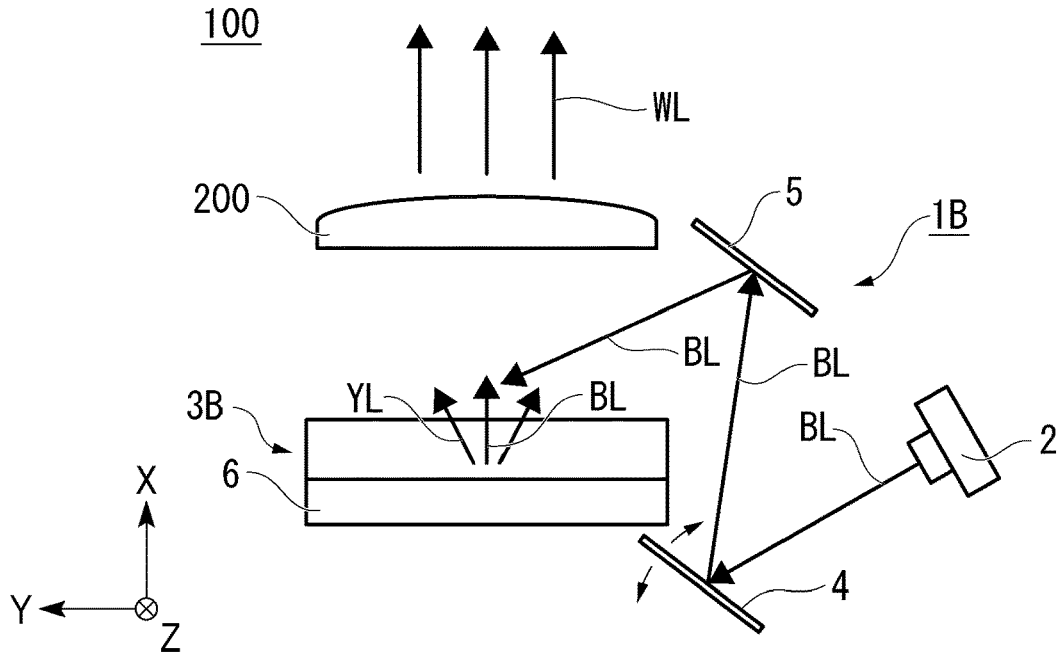
FIG. 2 is a schematic diagram showing a configuration of a vehicle lamp fixture including a reflection type lighting device according to the first embodiment of the present invention.

Meanwhile, as shown in FIG. 2, like the lighting device 1A, for example, the lighting device 1B of the embodiment is obtained by applying the present invention to a headlight (headlamp) for a vehicle configured to radiate the illumination light W toward a side in front of the vehicle (a +X-axis direction) as the vehicle lamp fixture 100 mounted on the vehicle.

The lighting device 1B constitutes the vehicle lamp fixture 100 by being accommodated in the lighting body (not shown) together with the projection lens 200 configured to project the illumination light WL toward a side in front of the vehicle.

Specifically, the lighting device 1B generally includes a laser light source 2 configured to emit a laser beam BL that is exciting light, a reflection type wavelength conversion member 3B configured to emit the wavelength converted fluorescent light YL excited by radiation of the laser beam BL, a laser beam scanning mechanism 4 configured to scan the laser beam BL radiated toward a wavelength conversion member 3B, and a reflector 5 configured to reflect the laser beam BL scanned by the laser beam scanning mechanism 4 toward the wavelength conversion member 3B.

That is, the lighting device 1B includes the reflection type wavelength conversion member 3B, instead of the transmission type wavelength conversion member 3A, and has basically the same configuration as the lighting device 1A except that disposition of the laser light source 2, the laser beam scanning mechanism 4 and the reflector 5 is changed according to disposition of the wavelength conversion member 3B.

The wavelength conversion member 3B has a configuration in which a reflection plate 6 is disposed on the side of the back surface of the phosphor plate that constitutes the wavelength conversion member 3A. The reflection plate 6 reflects the laser beam BL entering from the side of a front surface of the wavelength conversion member 3B and the fluorescent light YL excited in the wavelength conversion member 3B toward the front surface of the wavelength conversion member 3B.

In the lighting device 1B of the embodiment, the laser beam (blue light) BL radiated toward the front surface of the wavelength conversion member 3B can be reflected by the wavelength conversion member 3B while being partially diffused, and the illumination light (white light) WL can be emitted toward the projection lens 200 on the front side by color mixing of this blue light and yellow light while emitting fluorescent light (yellow light) YL as yellow phosphor particles in the wavelength conversion member 3A are excited by radiation of the laser beam BL.

(Vehicle Lamp Fixture)

In the vehicle lamp fixture 100 of the embodiment, by providing the above-mentioned lighting devices 1A and 1B, the illumination light WL that forms a light distribution pattern for a low beam including a cutoff line on an upper end as a passing beam (low beam) or the illumination light WL that forms a light distribution pattern for a high beam above the light distribution pattern for a low beam as a traveling beam (high beam) can be projected toward a side in front of the vehicle by the projection lens 200.

In addition, the vehicle lamp fixture 100 of the embodiment may be a light distribution variable headlamp (ADB) configured to variably control a light distribution pattern of the illumination light WL projected toward the side in front of the vehicle through scanning of the laser beam BL.

Further, in the vehicle lamp fixture 100 of the embodiment, in order to improve safety upon driving, it is also possible for the projection lens 200 to project drawing light that forms an image (a light distribution pattern for drawing) toward a road surface through scanning of the laser beam BL separately from the illumination light WL projected toward the side in front of the vehicle.

In the lighting devices 1A and 1B of the embodiment having the above-mentioned configuration, an incidence angle of the laser beam BL scanned by the above-mentioned laser beam scanning mechanism 4 with respect to the wavelength conversion members 3A and 3B is set to an angle at which the laser beam BL does not directly enter the projection lens 200 when the wavelength conversion members 3A and 3B is damaged, chipped or fallen off.

Accordingly, in the vehicle lamp fixture 100 including the lighting devices 1A and 1B of the embodiment, even when flaws, damage, falling off, or the like, occurs in the wavelength conversion members 3A and 3B, it is possible to prevent the laser beam BL scanned by the laser beam scanning mechanism 4 from being emitted directly to the outside through the projection lens 200.

Figure 3:
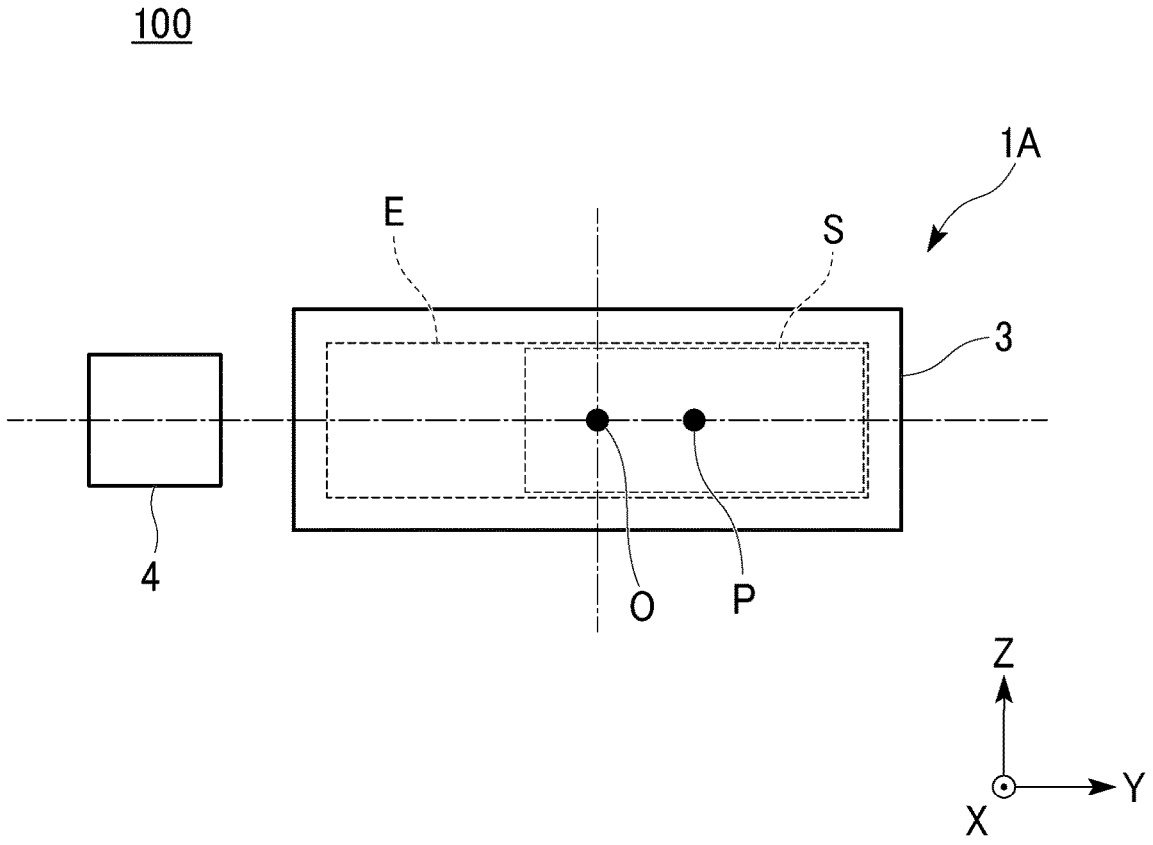
FIG. 3 is a front view of a lighting device showing a positional relation between a center of a laser beam irradiation region and a center of a scanning range of a laser beam.
Figure 4:
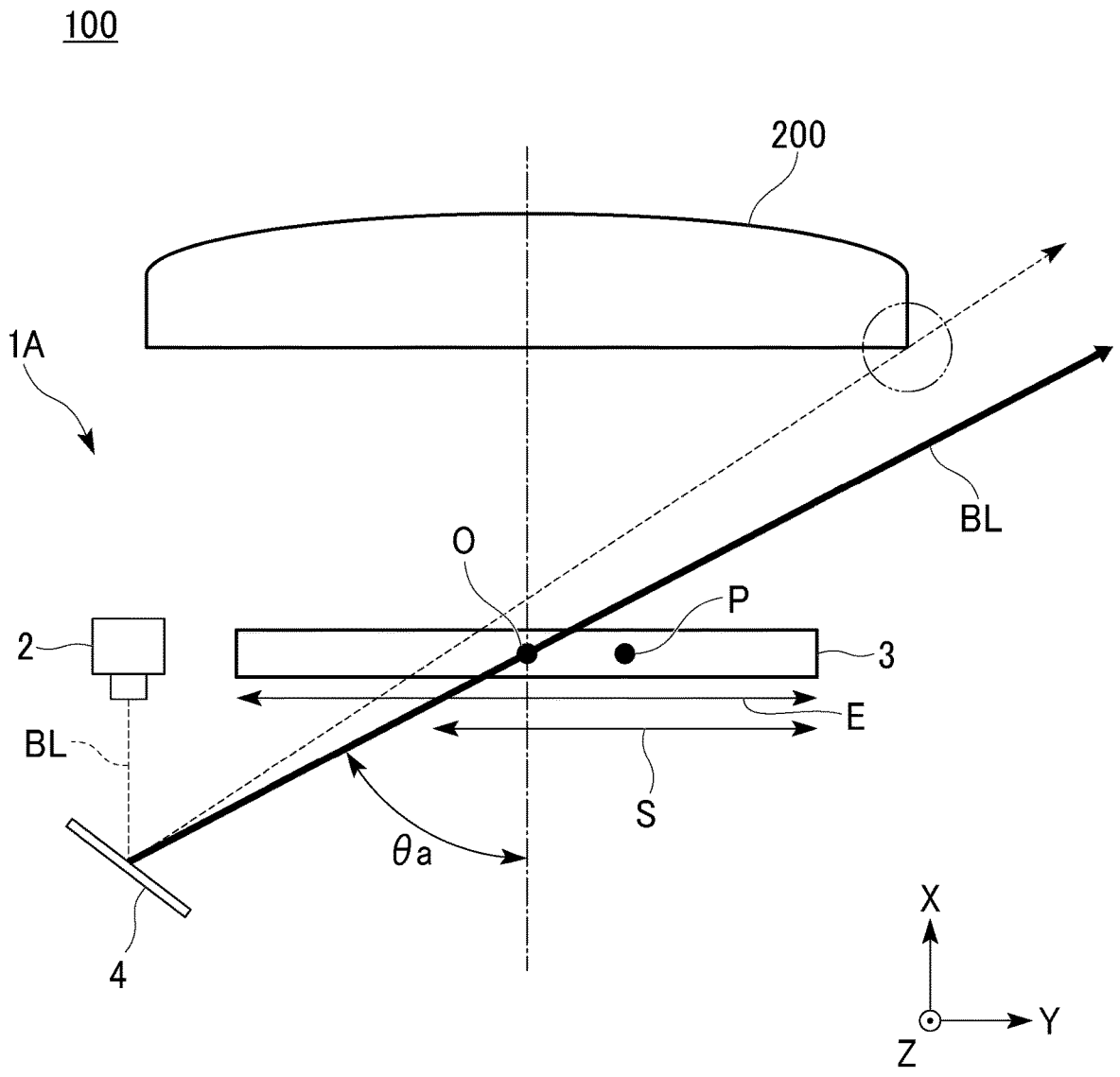
FIG. 4 is a plan view of the lighting device showing a positional relation between a center of a laser beam irradiation region and a center of a scanning range of a laser beam.

In addition, in the lighting devices 1A and 1B of the embodiment, as shown in FIG. 3 and FIG. 4, when the wavelength conversion member 3 is seen in a plan view, a center P of a scanning range S of the laser beam BL is disposed at a side opposite to a side where the laser beam scanning mechanism 4 is disposed with respect to a center O of a laser beam irradiation region E.

Here, the lighting devices 1A and 1B have basically the same configuration except that disposition of the laser light source 2, the laser beam scanning mechanism 4 and the reflector 5 is changed according to disposition of the transmission type wavelength conversion member 3A and the reflection type wavelength conversion member 3B, that are mentioned above.

Accordingly, in the following description, the transmission type wavelength conversion member 3A and the reflection type wavelength conversion member 3B are collectively treated as "the wavelength conversion member 3," and the present invention can also be applied similarly to the reflection type lighting device 1B although the description is performed while the transmission type lighting device 1A is exemplified in FIG. 3 and FIG. 4.

Further, FIG. 3 is a front view of the lighting device 1A showing a positional relation between the center O of the laser beam irradiation region E and the center P of the scanning range S of the laser beam BL. FIG. 4 is a plan view of the lighting device 1A showing a positional relation between the center O of the laser beam irradiation region E and the center P of the scanning range S of the laser beam BL. In addition, in FIG. 3 and FIG. 4, illustration of the reflector 5 is omitted.

Specifically, as shown in FIG. 3, the wavelength conversion member 3 has a rectangle (rectangular) laser irradiation region E when seen in a plan view (seen in the X-axis direction) to correspond to the light distribution pattern according to the scanning range S of the laser beam BL. In addition, a longitudinal direction of the laser irradiation region E corresponds to a leftward/rightward direction (Y-axis direction) of the light distribution pattern, and a short side direction of the laser irradiation region E corresponds to an upward/downward direction (Z-axis direction) of the light distribution pattern.

Accordingly, the laser beam irradiation region E has a so-called horizontally elongated shape in which a width corresponding to the leftward/rightward direction of the light distribution pattern is greater than a height corresponding to the upward/downward direction of the light distribution pattern when the wavelength conversion member 3 is seen in a plan view. Further, the laser beam irradiation region E may have a so-called square shape in which a width corresponding to the leftward/rightward direction of the light distribution pattern is equal to a height corresponding to the upward/downward direction of the light distribution pattern when the wavelength conversion member 3 is seen in a plan view.

In addition, the light distribution pattern when the illumination light WL radiated toward the side in front of the vehicle lamp fixture 100 is projected to a virtual vertical screen facing the vehicle lamp fixture 100 also has a horizontally elongated shape. According to this, disposition of the laser beam scanning mechanism 4 and control thereof are performed such that the scanning range S of the laser beam L with respect to the laser scanning region E of the wavelength conversion member 3 is also horizontally elongated.

Specifically, as shown in FIG. 3 and FIG. 4, the laser beam scanning mechanism 4 is disposed at either one (a left side in the embodiment) of a left side (one side) and a right side (the other side) that becomes the longitudinal direction of the light distribution pattern with respect to the above-mentioned laterally elongated wavelength conversion member 3. On the other hand, the center P of the scanning range S of the laser beam BL is located on a side (a right side in the embodiment) opposite to a side where the laser beam scanning mechanism 4 is disposed with respect to the center O of the laser beam irradiation region E. Here, as shown in FIG. 4, an incidence angle of the laser beam BL entering the center O of the laser beam irradiation region E is θa.

Figure 5:
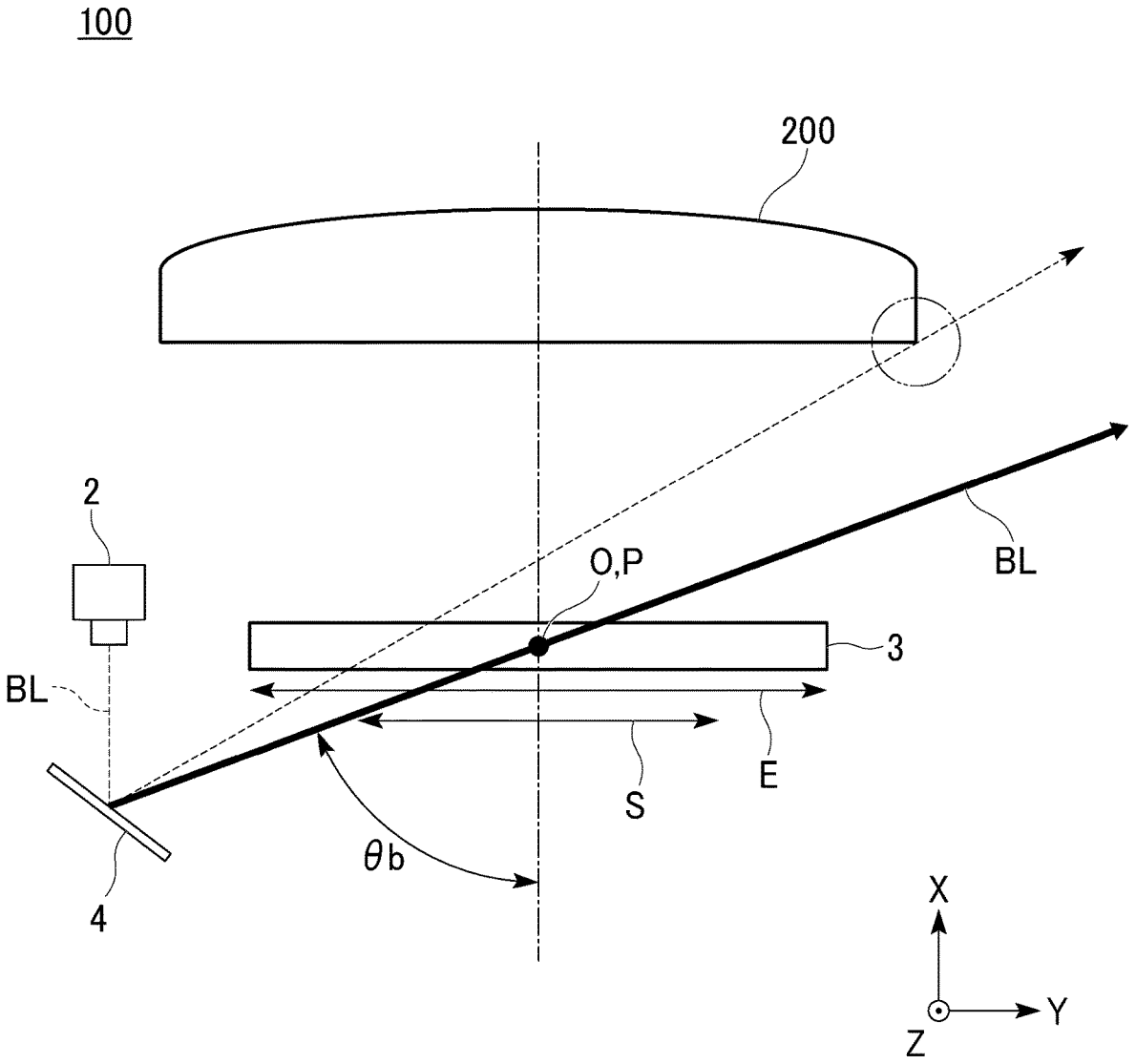
FIG. 5 is a plan view of the lighting device showing a case in which the center of the scanning range of the laser beam is located at the center of the laser beam irradiation region for comparison.

Meanwhile, for comparison, a case in which the center P of the scanning range S of the laser beam BL is located at the center O of the laser beam irradiation region E is shown in FIG. 5. Here, as shown in FIG. 5, an incidence angle of the laser beam BL entering the center O of the laser beam irradiation region E is θb.

In the case in which the incidence angle of the laser beam BL with respect to the wavelength conversion member 3 is set to an angle where the laser beam BL does not directly enter the projection lens 200, if the MEMS mirror of the laser beam scanning mechanism 4 is operated at the same deflection angle, the incidence angle θa shown in FIG. 4 may be smaller than the incidence angle θb shown in FIG. 5.

Accordingly, in the vehicle lamp fixture 100 including the lighting devices 1A and 1B of the embodiment, when the center P of the scanning range S of the laser beam BL is located at a side opposite to a side where the laser beam scanning mechanism 4 is disposed with respect to the center O of the laser beam irradiation region E, a spot size of the laser beam BL radiated to the wavelength conversion member 3 can be reduced. Accordingly, resolution of the light distribution pattern formed by the above-mentioned ADB can be increased.

Second Embodiment

Next, as a second embodiment of the present invention, for example, the vehicle lamp fixture 100 including a lighting device 1C shown in FIG. 6 and FIG. 7 will be described.

Figure 6:
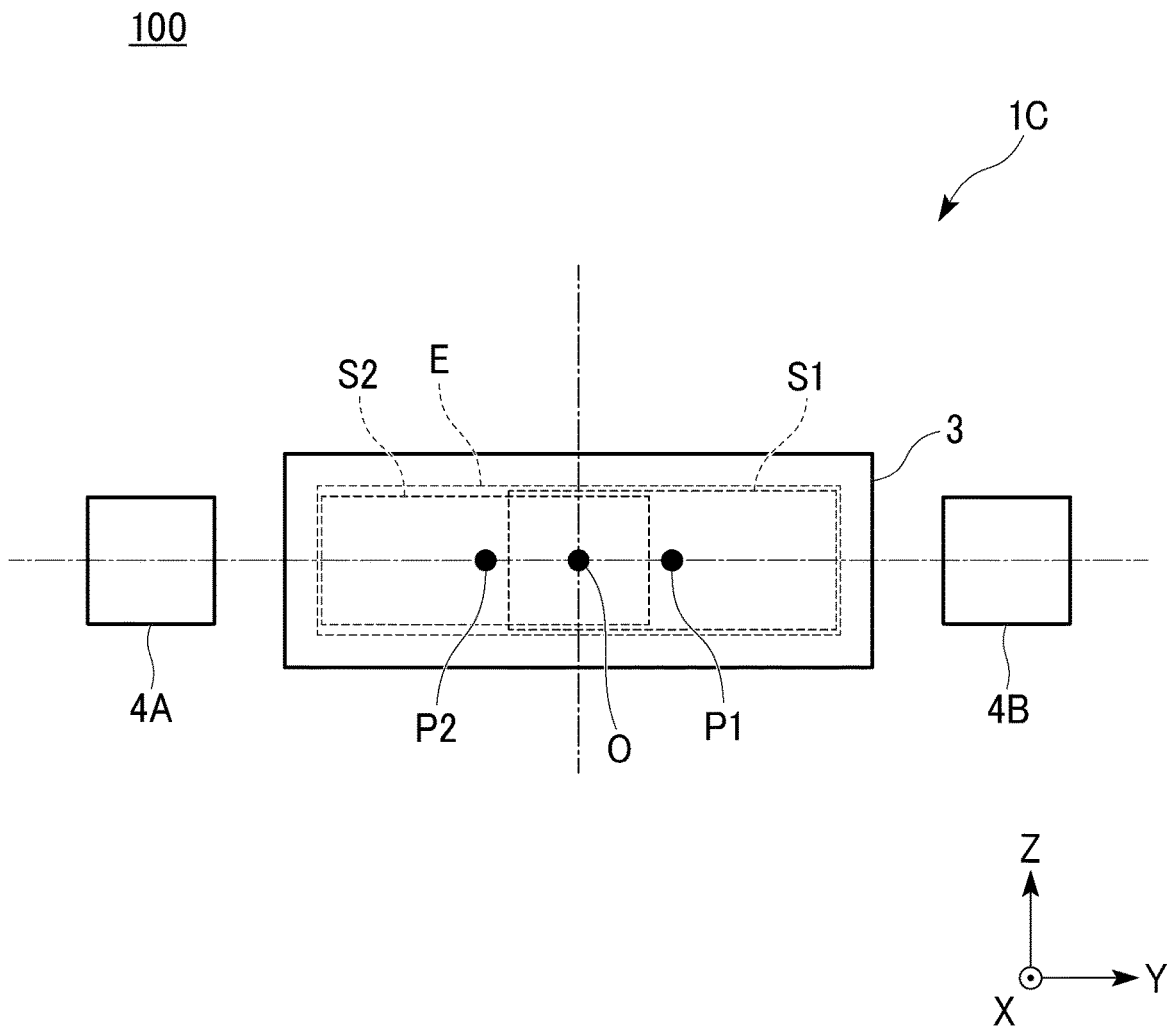
FIG. 6 is a schematic diagram showing a configuration of a vehicle lamp fixture including a lighting device according to a second embodiment of the present invention.

Further, FIG. 6 is a schematic diagram showing a configuration of the vehicle lamp fixture 100 including the lighting device 1C. FIG. 7 is a front view showing a positional relation between the center O of the laser beam irradiation region E of the lighting device 1C, the center P1 of the scanning range S1 of the laser beam BL1 on the left side and the center P2 of the scanning range S2 of the laser beam BL2 on the right side.

In addition, in the following description, the same parts of the lighting devices 1A and 1B are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied to the reflection type lighting device although description thereof is performed while exemplifying the transmission type lighting device 1C in FIG. 6 and FIG. 7.

Figure 7:
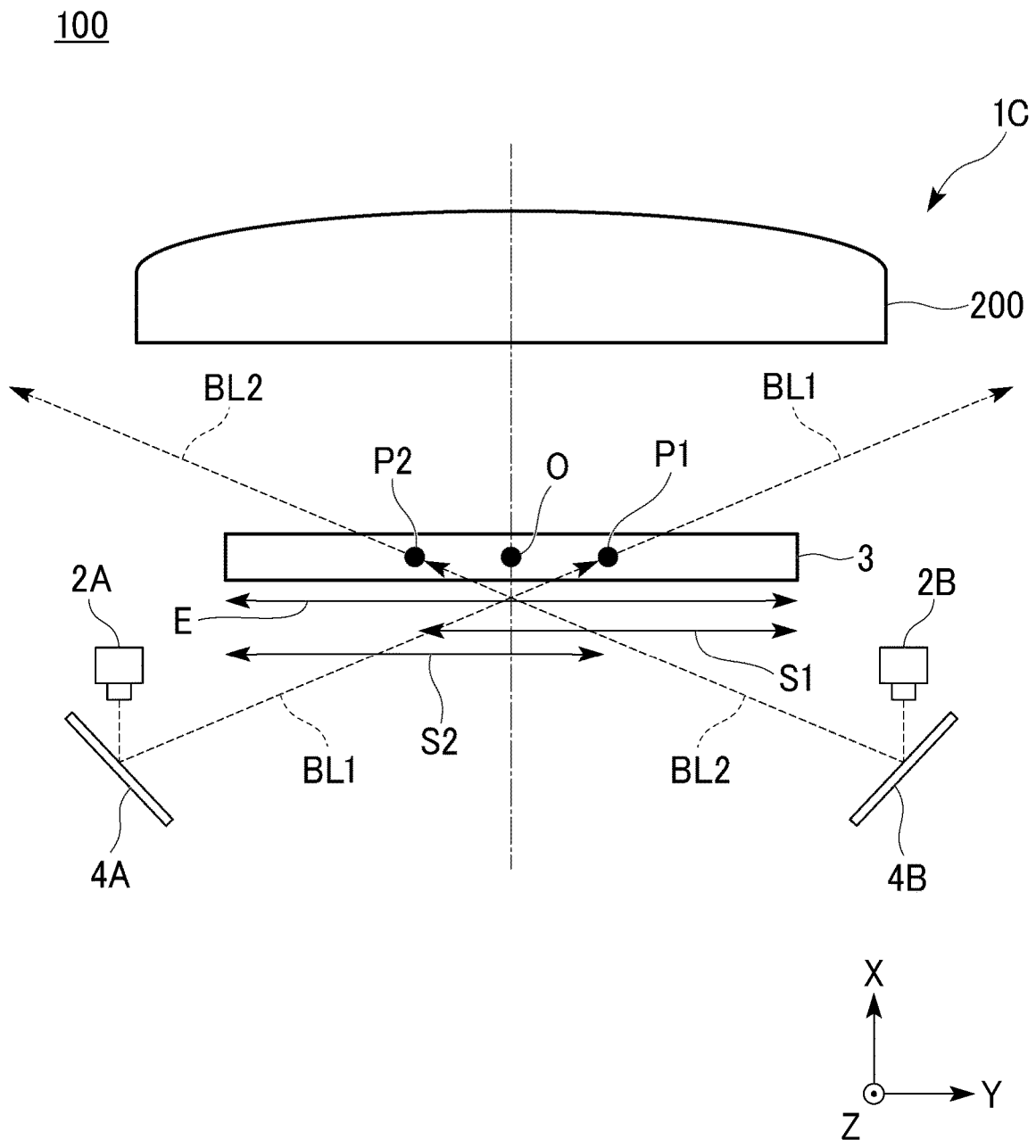
FIG. 7 is a front view showing a positional relation between a center of a laser beam irradiation region of the lighting device shown in FIG. 6, a center of a scanning range of a laser beam on the left side and a center of a scanning range of a laser beam on the right side.

As shown in FIG. 6 and FIG. 7, the vehicle lamp fixture 100 including the lighting device 1C of the embodiment has the laser light source 3A and the laser beam scanning mechanism 4A that are disposed at positions corresponding to the left side (one side) of the light distribution pattern, and the laser light source 3B and the laser beam scanning mechanism 4B that are disposed at positions corresponding to the right side (the other side) of the light distribution pattern, with respect to the wavelength conversion member 3. Other than that, basically the same configuration as that of the vehicle lamp fixture 100 including the lighting device 1A is provided.

The laser beam scanning mechanism 4A on the left side forms a light distribution pattern according to the scanning range S1 of a laser beam BL1 on the left side by scanning the laser beam BL1 on the left side (one side) radiated to the laser beam irradiation region E from the laser light source 2A on the left side.

The laser beam scanning mechanism 4B on the right side forms a light distribution pattern according to the scanning range S2 of the laser beam BL2 on the right side by scanning the laser beam BL2 on the right side (the other side) radiated toward the laser beam irradiation region E from the laser light source 2A on the right side.

In the lighting device 1C of the embodiment, one synthesis light distribution is formed by overlapping the light distribution pattern according to the scanning range S1 of the laser beam BL1 on the left side and the light distribution pattern according to the scanning range S2 of the laser beam BL2 on the right side.

In the lighting device 1C of the embodiment having the above-mentioned configuration, the incidence angles of the laser beams BL1 and BL2 on the left side and the right side, which are scanned by the laser beam scanning mechanisms 4A and 4B on the left side and the right side, with respect to the wavelength conversion member 3 is set to angles where the laser beams BL1 and BL2 do not directly enter the projection lens 200 when the wavelength conversion member 3 is damaged, chipped or peeled off.

Accordingly, in the vehicle lamp fixture 100 including the lighting device 1C of the embodiment, even when flaws, damage, falling off, or the like, occurs in the wavelength conversion member 3, it is possible to prevent the laser beams BL1 and BL2 on the left side and the right side, which are scanned by the laser beam scanning mechanisms 4A and 4B on the left side and the right side, from being emitted directly to the outside through the projection lens 200.

In addition, in the lighting device 1C of the embodiment, when the wavelength conversion member 3 is seen in a plan view, the center P1 of the scanning range S1 of the laser beam BL1 on the left side is located at a side (right side) opposite to the side where the laser beam scanning mechanism 4A is disposed on the left side of the center O of the laser beam irradiation region E. On the other hand, the center P2 of the scanning range S2 of the laser beam BL2 on the right side is located at a side (left side) opposite to the side where the laser beam scanning mechanism 4B is disposed on the right side of the center O of the laser beam irradiation region E.

Accordingly, in the vehicle lamp fixture 100 including the lighting device 1C of the embodiment, it is possible to reduce the spot sizes of the laser beams BL1 and BL2 on the left side and the right side radiated to the wavelength conversion member 3. As a result, it is possible to increase resolution of the light distribution pattern formed by the above-mentioned ADB.

Third Embodiment

Next, as a third embodiment of the present invention, for example, the vehicle lamp fixture 100 including a lighting device 1D shown in FIG. 8 and FIG. 9 will be described.

Figure 8:
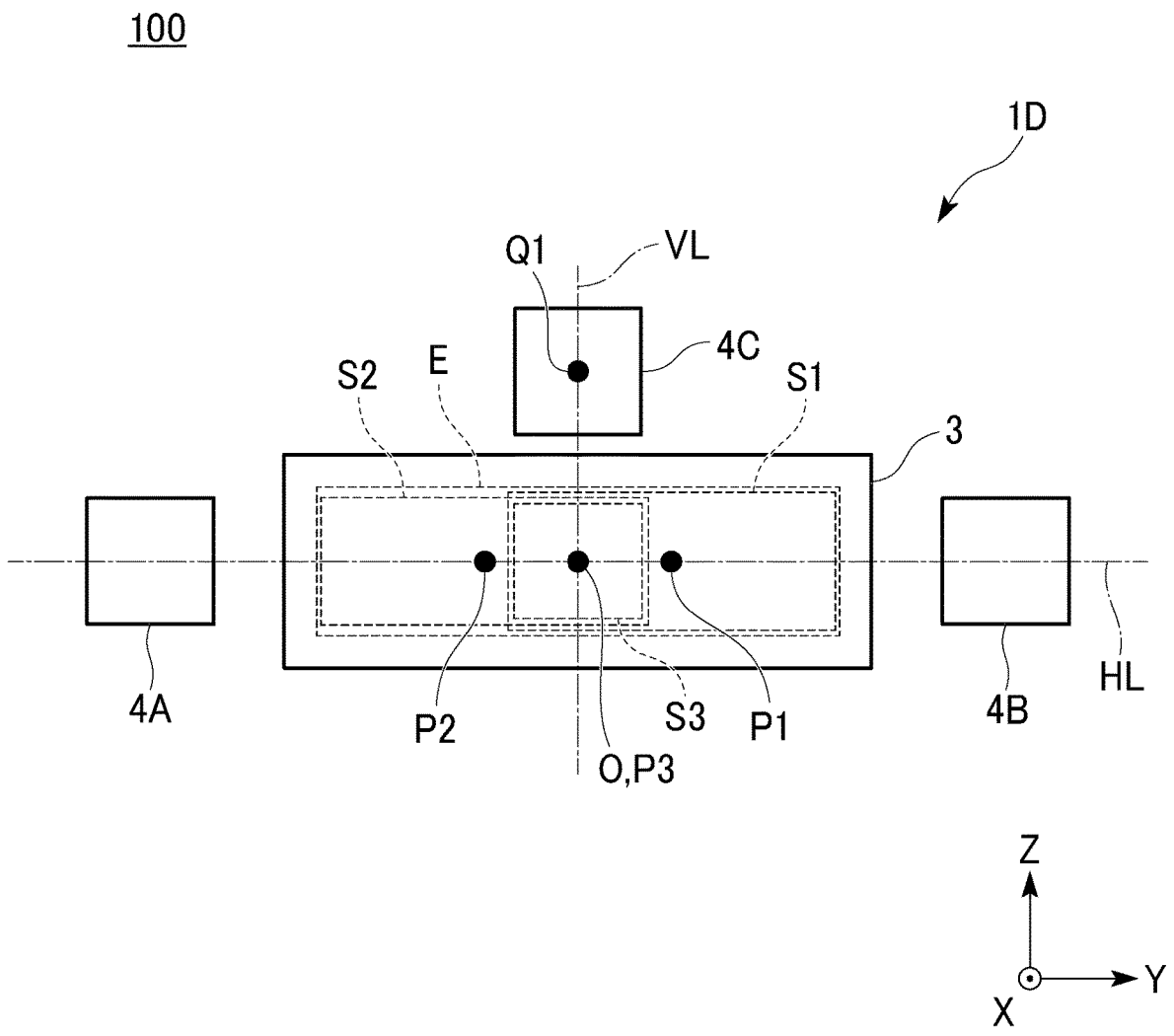
FIG. 8 is a schematic diagram showing a configuration of a vehicle lamp fixture including a lighting device according to a third embodiment of the present invention.

Further, FIG. 8 is a schematic diagram showing a configuration of the vehicle lamp fixture 100 including the lighting device 1D. FIG. 9 is a front view showing a positional relation between the center O of the laser beam irradiation region E of the lighting device 1D, the center P1 of the scanning range S1 of the laser beam BL1 on the left side, the center P2 of the scanning range S2 of the laser beam BL2 on the right side and the center P3 of the scanning range S3 of the laser beam BL3 on the upper side.

In addition, in the following description, the same parts as the lighting device 1C are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied similarly to the reflection type lighting device although the description thereof is performed while exemplifying the transmission type lighting device 1D in FIG. 8 and FIG. 9.

Figure 9:
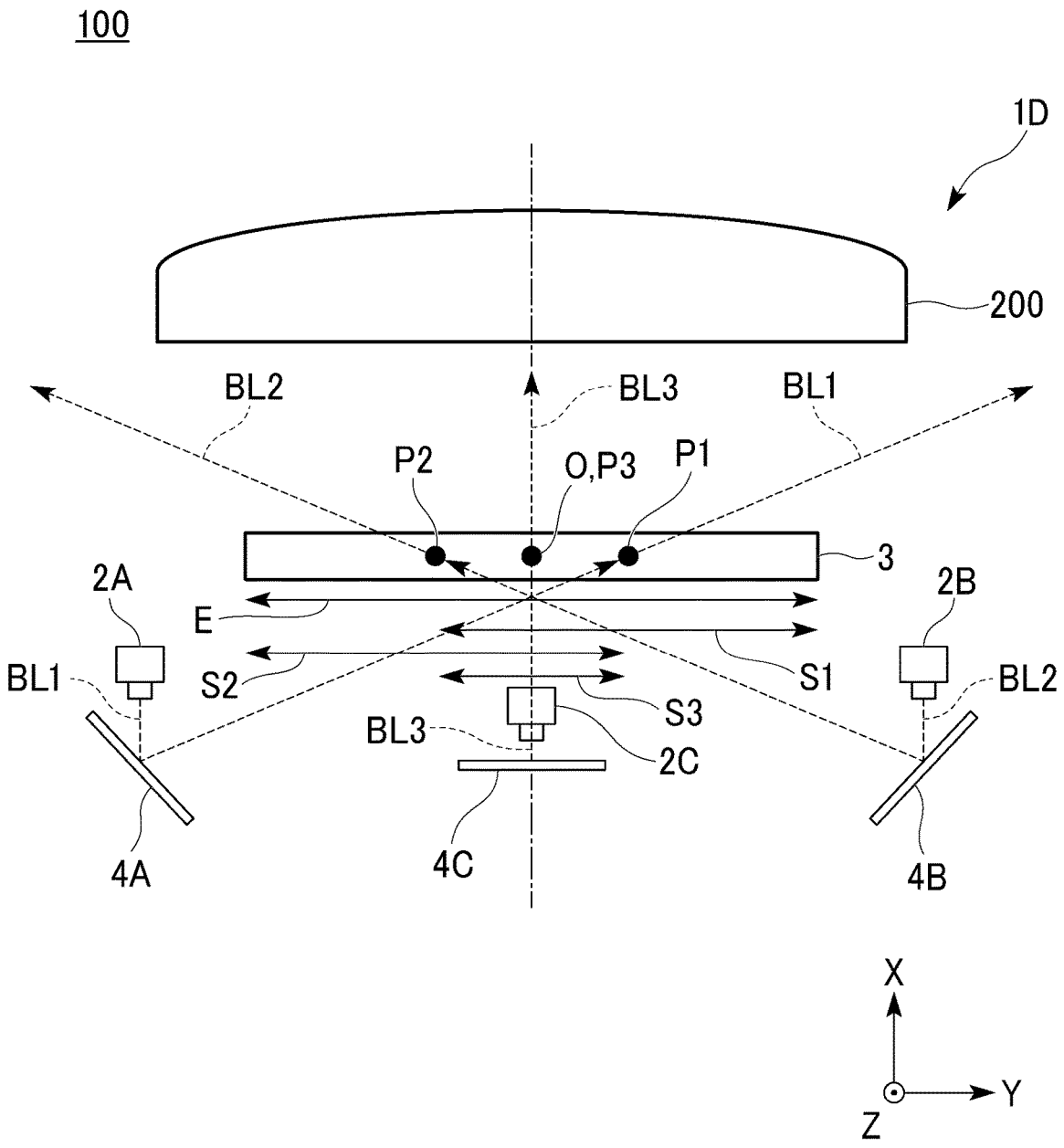
FIG. 9 is a front view showing a positional relation between a center of a laser beam irradiation region of the lighting device shown in FIG. 8, a center of a scanning range of a laser beam on the left side, a center of a scanning range of a laser beam on the right side and a center of a scanning range of a laser beam on the upper side.

As shown in FIG. 8 and FIG. 9, the vehicle lamp fixture 100 including the lighting device 1D of the embodiment has a laser light source 2C and a laser beam scanning mechanism 4C additionally disposed on either one of an upper side (one side) and a lower side (the other side) (the upper side in the embodiment) in the short side direction of the light distribution pattern with respect to the wavelength conversion member 3, in addition to the configuration of the lighting device 1C.

The laser beam scanning mechanism 4C on the upper side forms a light distribution pattern according to the scanning range S3 of the laser beam BL3 on the upper side by scanning the laser beam BL3 on the upper side (additional) radiated toward the laser beam irradiation region E from the laser light source 2C on the upper side.

In the lighting device 1D of the embodiment, one synthesis light distribution pattern is formed by overlapping the light distribution pattern according to the scanning range S1 of the laser beam BL1 on the left side, the light distribution pattern according to the scanning range S2 of the laser beam BL2 on the right side and the light distribution pattern according to the scanning range S3 of the laser beam BL3 on the upper side.

In addition, in the lighting device 1D of the embodiment, when the wavelength conversion member 3 is seen in a plan view, the center P3 of the scanning range S3 of the laser beam BL3 on the upper side is located at an intersection between a vertical line VL1 corresponding to the upward/downward direction of the light distribution pattern passing through a center Q1 of the laser beam scanning mechanism 4C on the upper side and a horizontal line HL corresponding to the leftward/rightward direction of the light distribution pattern passing through the center O of the laser beam irradiation region E.

Further, in the embodiment, since the laser beam scanning mechanism 4C on the upper side is located at an upper center side with respect to the wavelength conversion member 3, the center P3 of the scanning range S3 of the laser beam BL3 on the upper side is located at a position that matches with the center O of the laser beam irradiation region E.

In the lighting device 1D of the embodiment having the above-mentioned configuration, incidence angles of the laser beams BL1, BL2 and BL3 on the left side, the right side and the upper side, which are scanned by the laser beam scanning mechanisms 4A, 4B and 4C on the left side, the right side and the upper side, with respect to the wavelength conversion member 3 are set to angles where the laser beams BL1, BL2 and BL3 do not directly enter the projection lens 200 when the wavelength conversion member 3 is damaged, chipped or fallen off.

Accordingly, in the vehicle lamp fixture 100 including the lighting device 1D of the embodiment, even when flaws, damage, falling off, or the like, occurs in the wavelength conversion member 3, it is possible to prevent the laser beams BL1, BL2 and BL3 on the left side, the right side and the upper side scanned by the laser beam scanning mechanisms 4A, 4B and 4C on the left side, the right side and the upper side from being emitted directly to the outside through the projection lens 200.

In addition, in the lighting device 1D of the embodiment, when the wavelength conversion member 3 is seen in a plan view, the center P1 of the scanning range S1 of the laser beam BL1 on the left side is located at a side (right side) opposite to the side where the laser beam scanning mechanism 4A is disposed at the left side with respect to the center O of the laser beam irradiation region E. On the other hand, the center P2 of the scanning range S2 of the laser beam BL2 on the right side is located at a side (left side) opposite to the side where the laser beam scanning mechanism 4B is disposed at the right side with respect to the center O of the laser beam irradiation region E.

Accordingly, in the vehicle lamp fixture 100 including the lighting device 1D of the embodiment, it is possible to reduce spot sizes of the laser beams BL1 and BL2 on the left side and the right side radiated to the wavelength conversion member 3. As a result, it is possible to increase resolution of the light distribution pattern formed by the above-mentioned ADB.

Fourth Embodiment

Next, as a fourth embodiment of the present invention, for example, the vehicle lamp fixture 100 including a lighting device 1E shown in FIG. 10 and FIG. 11 will be described.

Figure 10:
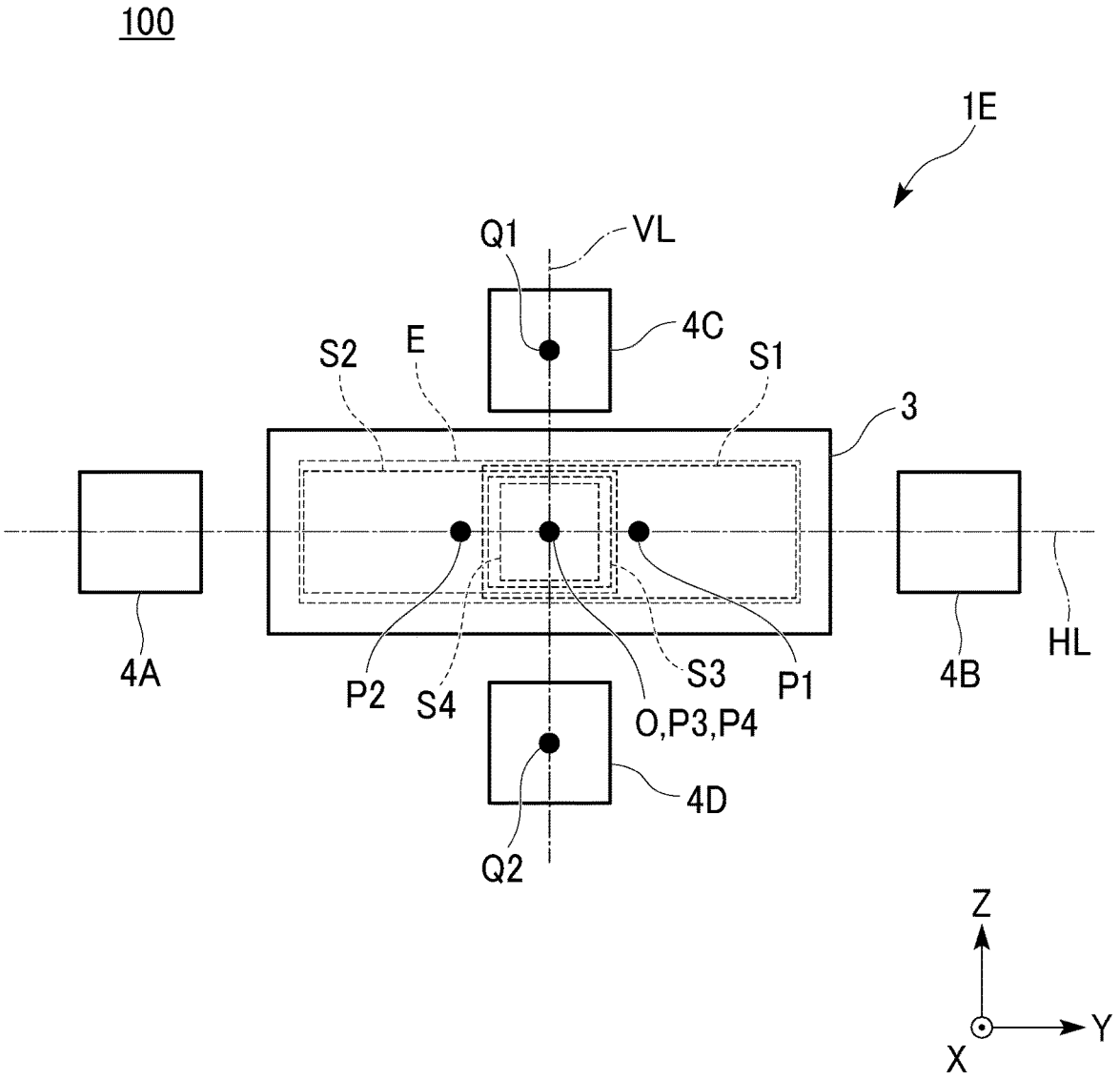
FIG. 10 is a schematic diagram showing a configuration of a vehicle lamp fixture including a lighting device according to a fourth embodiment of the present invention.

Further, FIG. 10 is a schematic diagram showing a configuration of the vehicle lamp fixture 100 including the lighting device 1E. FIG. 11 is a front view showing a positional relation between the center O of the laser beam irradiation region E of the lighting device 1E, the center P1 of the scanning range S1 of the laser beam BL1 on the left side, the center P2 of the scanning range S2 of the laser beam BL2 on the right side, the center P3 of the scanning range S3 of the laser beam BL3 at the upper side and the center P4 of the scanning range S4 of the laser beam BL4 at the lower side.

In addition, in the following description, the same parts as the lighting device 1C are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied similarly to the reflection type lighting device although the description is performed while exemplifying the transmission type lighting device 1E in FIG. 10 and FIG. 11.

Figure 11:
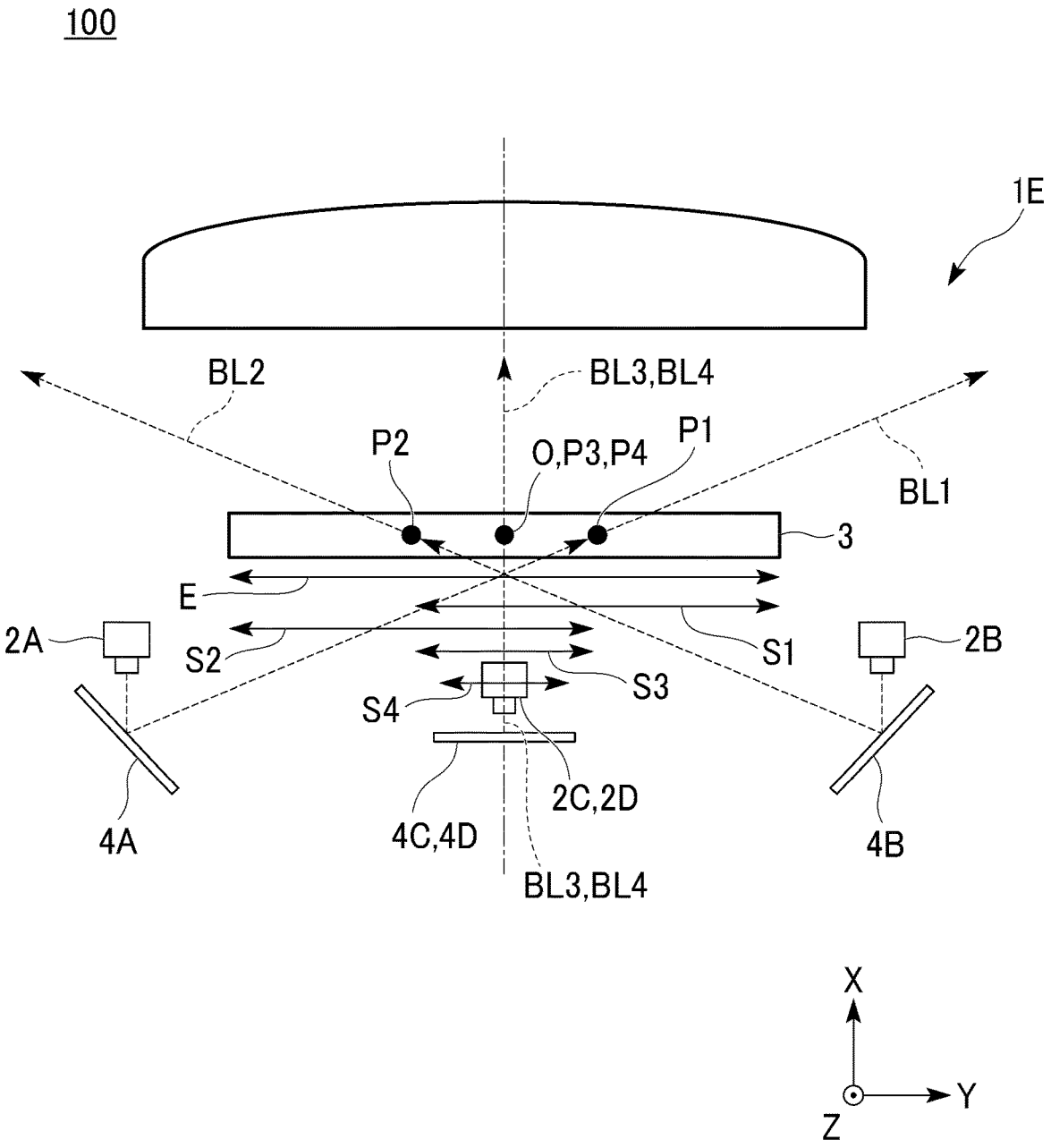
FIG. 11 is a front view showing a positional relation between a center of a laser beam irradiation region of the lighting device shown in FIG. 10, a center of a scanning range of a laser beam on the left side, a center of a scanning range of a laser beam on the right side, a center of a scanning range of a laser beam on the upper side, and a center of a scanning range of a laser beam on the lower side.

As shown in FIG. 10 and FIG. 11, in addition to the configuration of the lighting device 1C, the vehicle lamp fixture 100 including the lighting device 1E of the embodiment has the laser light source 2C and the laser beam scanning mechanism 4C at the upper side which are disposed to correspond to the upper side (one side) that is the short side direction of the light distribution pattern and the laser light source 2D and the laser beam scanning mechanism 4D at the lower side which are disposed to correspond to the lower side (the other side) that is the short side direction of the light distribution pattern, with respect to the wavelength conversion member 3.

The laser beam scanning mechanism 4C on the upper side forms a light distribution pattern according to the scanning range S3 of the laser beam BL3 on the upper side by scanning the laser beam BL3 on the upper side radiated toward the laser beam irradiation region E from the laser light source 2C on the upper side.

The laser beam scanning mechanism 4C at the lower side forms a light distribution pattern according to the scanning range S4 of the laser beam BL4 at the lower side by scanning the laser beam BL4 at the lower side radiated toward the laser beam irradiation region E from the laser light source 2D at the lower side.

In the lighting device 1E of the embodiment, one synthesis light distribution pattern is formed by overlapping the light distribution pattern according to the scanning range S1 of the laser beam BL1 on the left side, the light distribution pattern according to the scanning range S2 of the laser beam BL2 on the right side, the light distribution pattern according to the scanning range S3 of the laser beam BL3 on the upper side and light distribution pattern according to the scanning range S4 of the laser beam BL4 on the lower side.

In addition, in the lighting device 1E of the embodiment, when the wavelength conversion member 3 is seen in a plan view, the center P3 of the scanning range S3 of the laser beam BL3 on the upper side is located at an intersection between the vertical line VL1 corresponding to the upward/downward direction of the light distribution pattern passing through the center Q1 of the laser beam scanning mechanism 4C on the upper side and the horizontal line HL corresponding to the leftward/rightward direction of the light distribution pattern passing through the center O of the laser beam irradiation region E. On the other hand, the center P4 of the scanning range S4 of the laser beam BL4 on the lower side is located at an intersection between a vertical line VL2 corresponding to the upward/downward direction of the light distribution pattern passing through a center Q2 of the laser beam scanning mechanism 4D on the lower side and the horizontal line HL corresponding to the leftward/rightward direction of the light distribution pattern passing through the center O of the laser beam irradiation region E.

Further, in the embodiment, since the laser beam scanning mechanism 4C on the upper side is located at an upper center side with respect to the wavelength conversion member 3 and the laser beam scanning mechanism 4C on the lower side is located at a lower center side with respect to the wavelength conversion member 3, the centers P3 and P4 of the scanning ranges S3 and S4 of the laser beams BL3 and BL4 on the upper side and the lower side are located at positions that match with the center O of the laser beam irradiation region E.

In the lighting device 1E of the embodiment having the above-mentioned configuration, incidence angles of the laser beams BL1, BL2, BL3 and BL4 on the left side, the right side, the upper side and the lower side, which are scanned by the laser beam scanning mechanisms 4A, 4B, 4C and 4D on the left side, the right side, the upper side and the lower side, with respect to the wavelength conversion member 3 are set to angles where the laser beam BL does not directly enter the projection lens 200 when the wavelength conversion member 3 is damaged, chipped or fallen off.

Accordingly, in the vehicle lamp fixture 100 including the lighting device 1E of the embodiment, even when flaws, damage, falling off, or the like, occurs in the wavelength conversion member 3, it is possible to prevent the laser beams BL1, BL2, BL3 and BL4 on the left side, the right side, the upper side and the lower side scanned by the laser beam scanning mechanisms 4A, 4B, 4C and 4D on the left side, the right side, the upper side and the lower side from being emitted directly to the outside through the projection lens 200.

In addition, in the lighting device 1E of the embodiment, when the wavelength conversion member 3 is seen in a plan view, the center P1 of the scanning range S1 of the laser beam BL1 on the left side is located at a side (right side) opposite to the side where the laser beam scanning mechanism 4A on the left side is disposed with respect to the center O of the laser beam irradiation region E. On the other hand, the center P2 of the scanning range S2 of the laser beam BL2 on the right side is located at a side (left side) opposite to the side where the laser beam scanning mechanism 4B on the right side is disposed with respect to the center O of the laser beam irradiation region E.

Accordingly, in the vehicle lamp fixture 100 including the lighting device 1E of the embodiment, it is possible to reduce spot sizes of the laser beams BL1 and BL2 on the left side and the right side radiated to the wavelength conversion member 3. As a result, it is possible to increase resolution of the light distribution pattern formed by the above-mentioned ADB.

Fifth Embodiment

Next, as a fifth embodiment of the present invention, for example, the vehicle lamp fixture 100 including a lighting device 1F shown in FIG. 12 and FIG. 13 will be described.

Further, FIG. 10 is a schematic diagram showing a configuration of the vehicle lamp fixture 100 including the lighting device 1F. FIG. 11 is a front view showing a positional relation between the center O of the laser beam irradiation region E of the lighting device 1F, the center P1 of the scanning range S1 of the laser beam BL1 on the left side, the center P2 of the scanning range S2 of the laser beam BL2 on the right side, the center P3 of the scanning range S3 of the laser beam BL3 on the upper side and the center P4 of the scanning range S4 of the laser beam BL4 on the lower side.

In addition, in the following description, the same parts as the lighting device 1E are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied similarly to the reflection type lighting device although the description is performed while exemplifying a transmission type lighting device 1F in FIG. 10 and FIG. 11.

Figure 12:
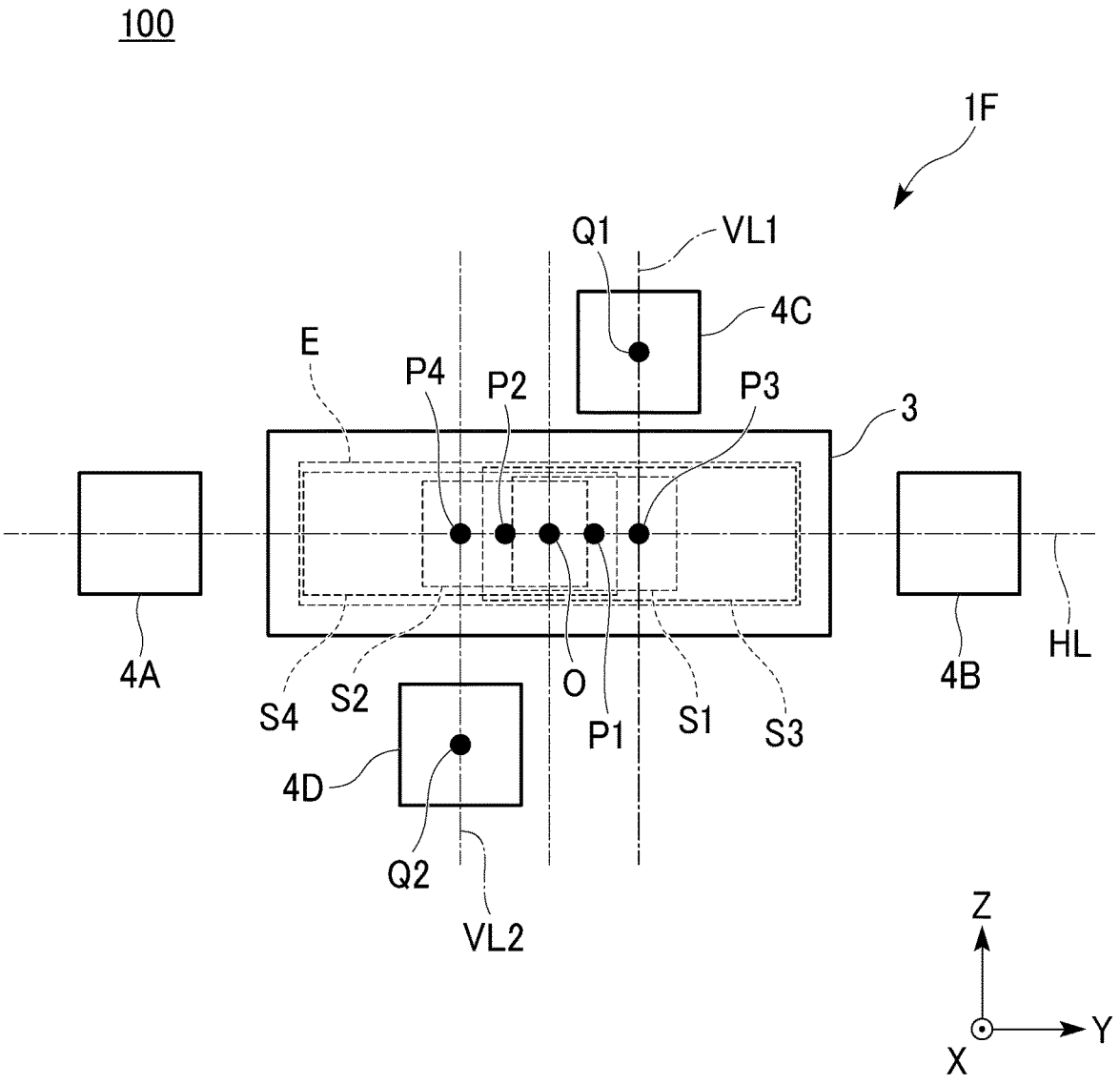
FIG. 12 is a schematic diagram showing a configuration of a vehicle lamp fixture including a lighting device according to a fifth embodiment of the present invention.
Figure 13:
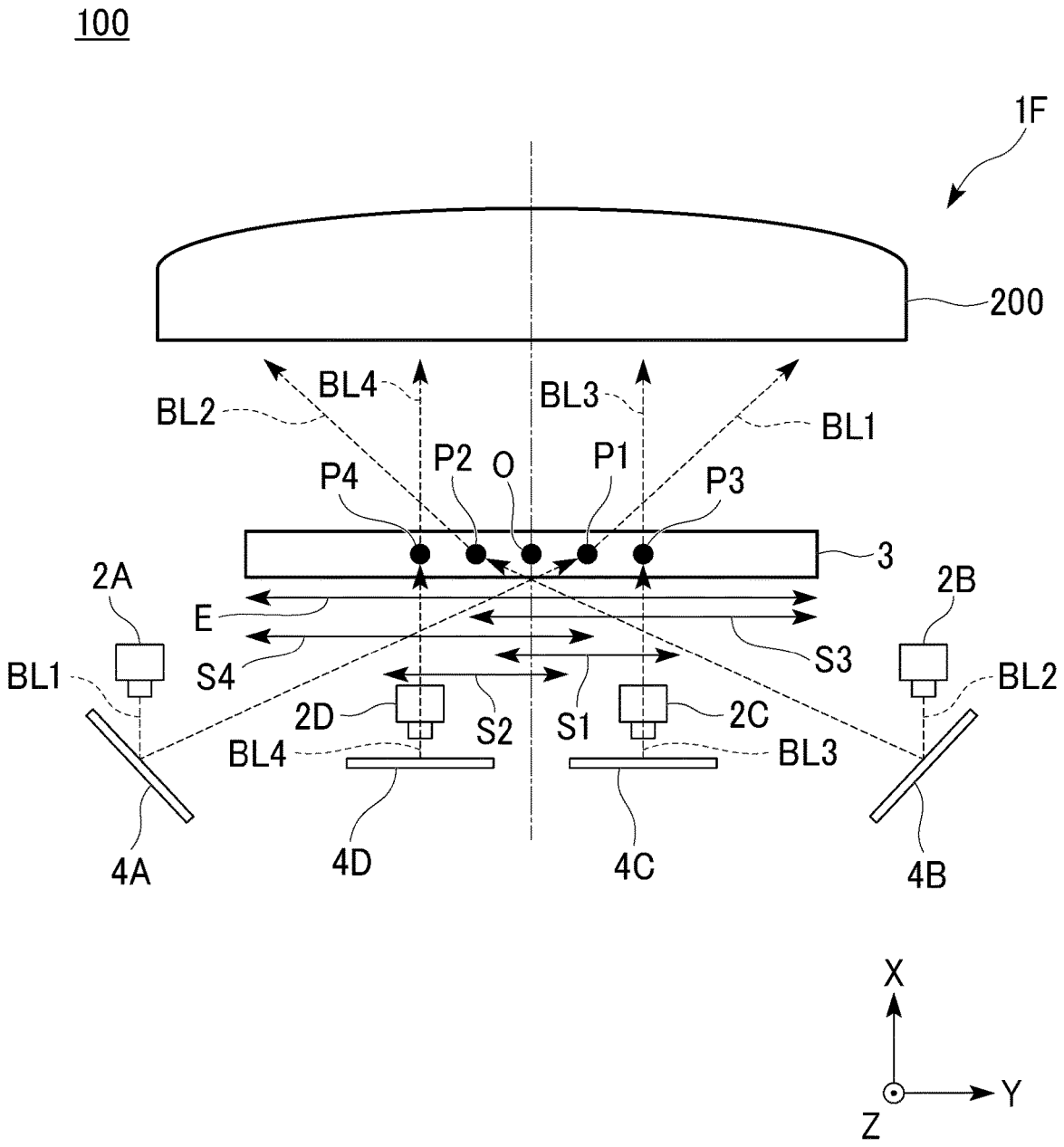
FIG. 13 is a front view showing a positional relation between a center of a laser beam irradiation region of the lighting device shown in FIG. 12, a center of a scanning range of a laser beam on the left side, a center of a scanning range of a laser beam on the right side, a center of a scanning range of a laser beam on the upper side and a center of a scanning range of a laser beam on the lower side.

As shown in FIG. 12 and FIG. 13, among the configuration of the lighting device 1E, the vehicle lamp fixture 100 including the lighting device 1F of the embodiment has a configuration in which the laser light source 2C and the laser beam scanning mechanism 4C on the upper side are disposed to be deviated to the left side (one side) of the longitudinal direction of the light distribution pattern with respect to the wavelength conversion member 3, and the laser light source 2D and the laser beam scanning mechanism 4D on the lower side are disposed to be deviated to the right side (the other side) of the longitudinal direction of the light distribution pattern with respect to the wavelength conversion member 3.

Accordingly, in the lighting device 1F of the embodiment, when the wavelength conversion member 3 is seen in a plan view, the center P3 of the scanning range S3 of the laser beam BL3 on the upper side and the center P4 of the scanning range S4 of the laser beam BL4 on the lower side are located on the left side and the right side with the center O of the laser beam irradiation region E sandwiched therebetween.

In the lighting device 1F of the embodiment having the above-mentioned configuration, incidence angles of the laser beams BL1, BL2, BL3 and BL4 on the left side, the right side, the upper side and the lower side, which are scanned by the laser beam scanning mechanisms 4A, 4B, 4C and 4D on the left side, the right side, the upper side and the lower side, with respect to the wavelength conversion member 3 are set to angles where the laser beam BL does not directly enter the projection lens 200 when the wavelength conversion member 3 is damaged, chipped or fallen off.

Accordingly, in the vehicle lamp fixture 100 including the lighting device 1F of the embodiment, even when flaws, damage, falling off, or the like, occurs in the wavelength conversion member 3, it is possible to prevent the laser beams BL1, BL2, BL3 and BL4 on the left side, the right side, the upper side and the lower side, which are scanned by the laser beam scanning mechanisms 4A, 4B, 4C and 4D on the left side, the right side, the upper side and the lower side, from being emitted directly to the outside through the projection lens 200.

In addition, in the lighting device 1F of the embodiment, when the wavelength conversion member 3 is seen in a plan view, the center P1 of the scanning range S1 of the laser beam BL1 on the left side is located at a side (right side) opposite to the side where the laser beam scanning mechanism 4A on the left side is disposed with respect to the center O of the laser beam irradiation region E. On the other hand, the center P2 of the scanning range S2 of the laser beam BL2 on the right side is located at a side (left side) opposite to the side where the laser beam scanning mechanism 4B on the right side is disposed with respect to the center O of the laser beam irradiation region E.

Accordingly, in the vehicle lamp fixture 100 including the lighting device 1F of the embodiment, it is possible to reduce spot sizes of the laser beams BL1 and BL2 on the left side and the right side radiated to the wavelength conversion member 3. As a result, it is possible to increase resolution of the light distribution pattern formed by the above-mentioned ADB.

Further, in the lighting device 1F of the embodiment, when the wavelength conversion member 3 is seen in a plan view, the center P3 of the scanning range S3 of the laser beam BL3 on the upper side is located on the left side with the center O of the laser beam irradiation region E sandwiched therebetween. On the other hand, the center P4 of the scanning range S4 of the laser beam BL4 on the lower side is located on the right side with the center O of the laser beam irradiation region E sandwiched therebetween.

Figure 14:
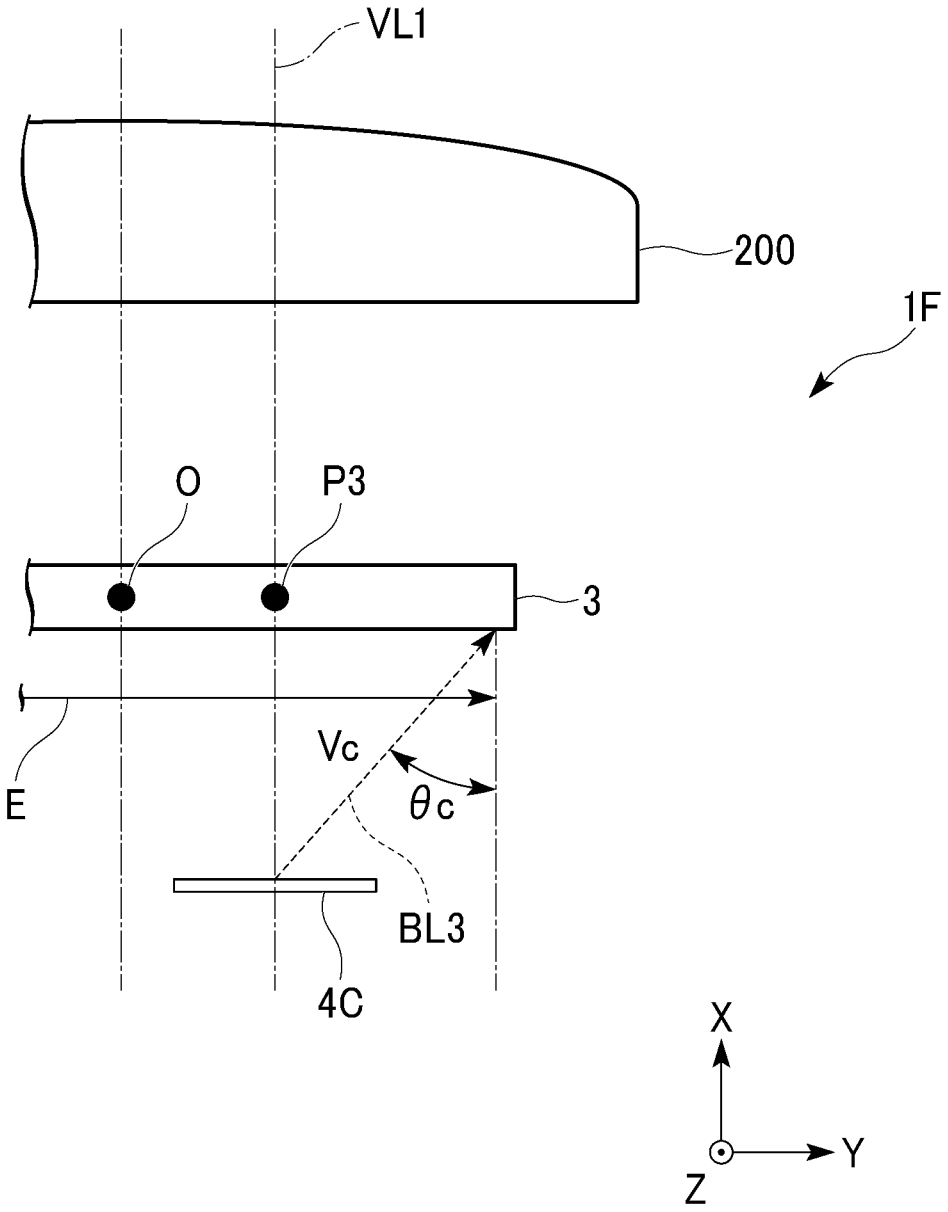
FIG. 14 is a schematic diagram showing an incidence vector and an incidence angle of a laser beam on the upper side entering an end portion of a laser beam irradiation region from a laser beam scanning mechanism on the upper side of the lighting device shown in FIG. 12.

Here, when the laser beam scanning mechanism 4C on the upper side shown in FIG. 12 is located on the right side of the longitudinal direction of the light distribution pattern with respect to the wavelength conversion member 3, as shown in FIG. 14, an incidence angle of the laser beam BL3 on the upper side, which enters the end portion of the laser beam irradiation region E on the right side, with respect to a normal line (X axis) of the wavelength conversion member 3 is set as θc, and set as an incidence vector Vc of the laser beam BL on the upper side.

Figure 15:
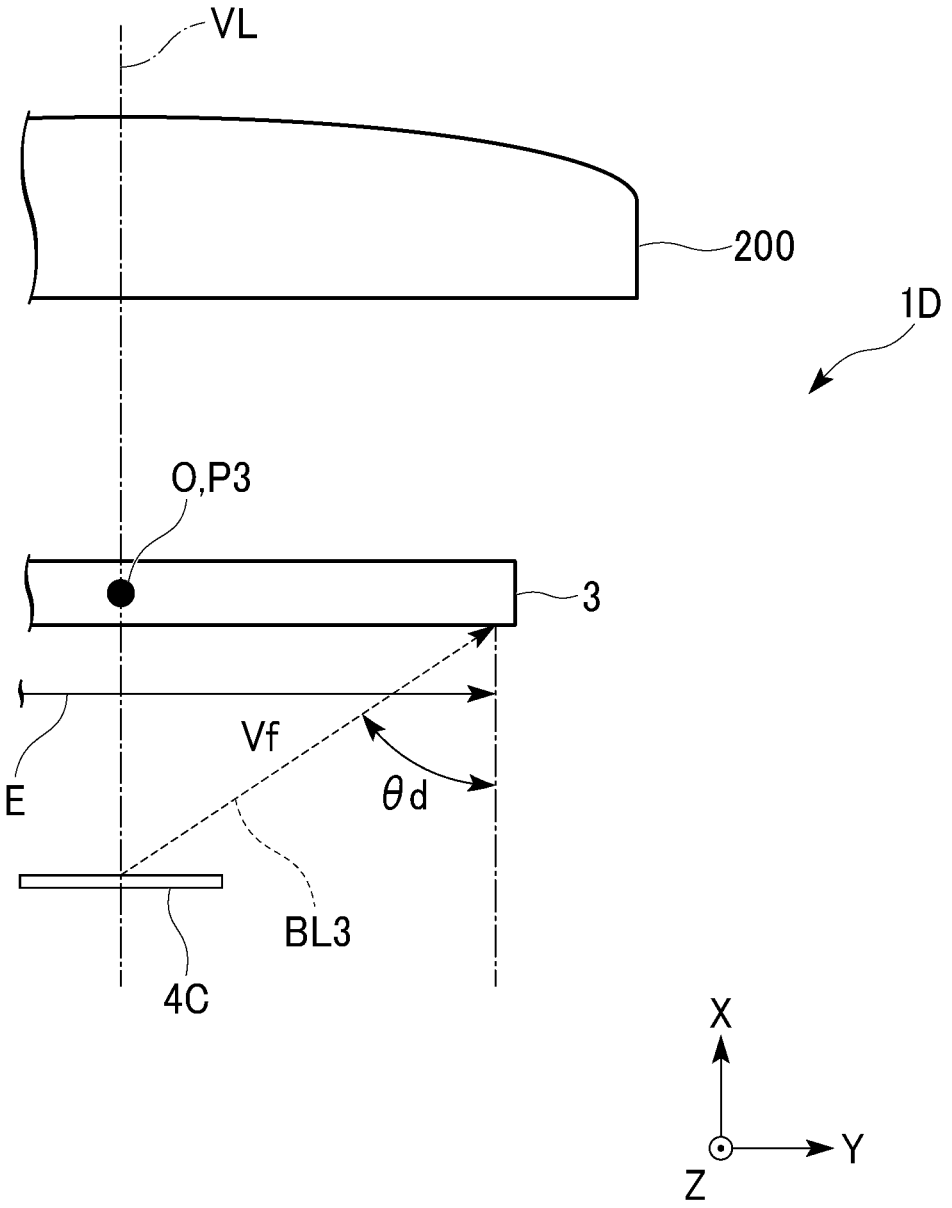
FIG. 15 is a schematic diagram showing an incidence vector and an incidence angle of a laser beam on the upper side entering an end portion of a laser beam irradiation region from a laser beam scanning mechanism located on an upper center side for comparison.

Meanwhile, for comparison, when the laser beam scanning mechanism 4C on the upper side shown in FIG. 8 is located at an upper center side with respect to the wavelength conversion member 3, as shown in FIG. 15, an incidence angle of the laser beam BL3 on the upper side, which enters the end portion of the laser beam irradiation region E on the right side, with respect to a normal line (X axis) of the wavelength conversion member 3 is set as θd, and set as an incidence vector Vd of the laser beam BL3 on the upper side.

In the case in which the incidence angle of the above mentioned laser beam BL with respect to the wavelength conversion member 3 is set to an angle where the laser beam BL does not directly enter the projection lens 200, if the MEMS mirror of the laser beam scanning mechanism 4 is operated in the same deflection angle, the incidence angle θc shown in FIG. 14 is possible to become smaller than the incidence angle θd shown in FIG. 15.

Incidentally, in the case in which the resonance type MEMS mirror is used as the laser beam scanning mechanism 4, if a driving voltage is applied to the MEMS mirror according to a driving signal of a sine wave, a speed when the MEMS mirror reciprocally swings is maximized in the vicinity of the center of the laser beam irradiation region E, and minimized in the vicinity of both left and right ends of the laser beam irradiation region E. According to this, the light intensity distribution in the surface of the laser beam irradiation region E is relatively increased in the vicinity of both left and right ends of the laser beam irradiation region E in which the speed is reduced.

A correction mirror can be used as a means configured to optically correct the light intensity distribution. The correction mirror can flatten the light intensity distribution by optically stretching the vicinity of both left and right ends of the laser beam irradiation region E where brightness is increased. However, according to this, the spot sizes in the vicinity of both left and right ends of the laser beam irradiation region E are increased. In addition, as the scanning range S of the laser beam BL is widened, correction in the vicinity of both left and right ends of the laser beam irradiation region E becomes necessary, and the spot sizes are increased.

On the other hand, the laser beam scanning mechanism 4 on the upper side can reduce the incidence angle θc in the vicinity of left and right end portions of the light intensity distribution in the surface of the laser beam irradiation region E by deviating the center P3 of the scanning range S of the laser beam BL3 on the upper side toward the right side with respect to the center O of the laser beam irradiation region E. Accordingly, it is possible to reduce the scanning range S3 of the laser beam BL3 on the upper side, and prevent the spot sizes in the vicinity of both left and right ends of the laser beam irradiation region E from being increased.

EXAMPLES

Hereinafter, effects of the present invention are made clearer by the examples. Further, the present invention is not limited to the following example, and can be appropriately modified and implemented without departing from the scope of the present invention.

Figure 16:
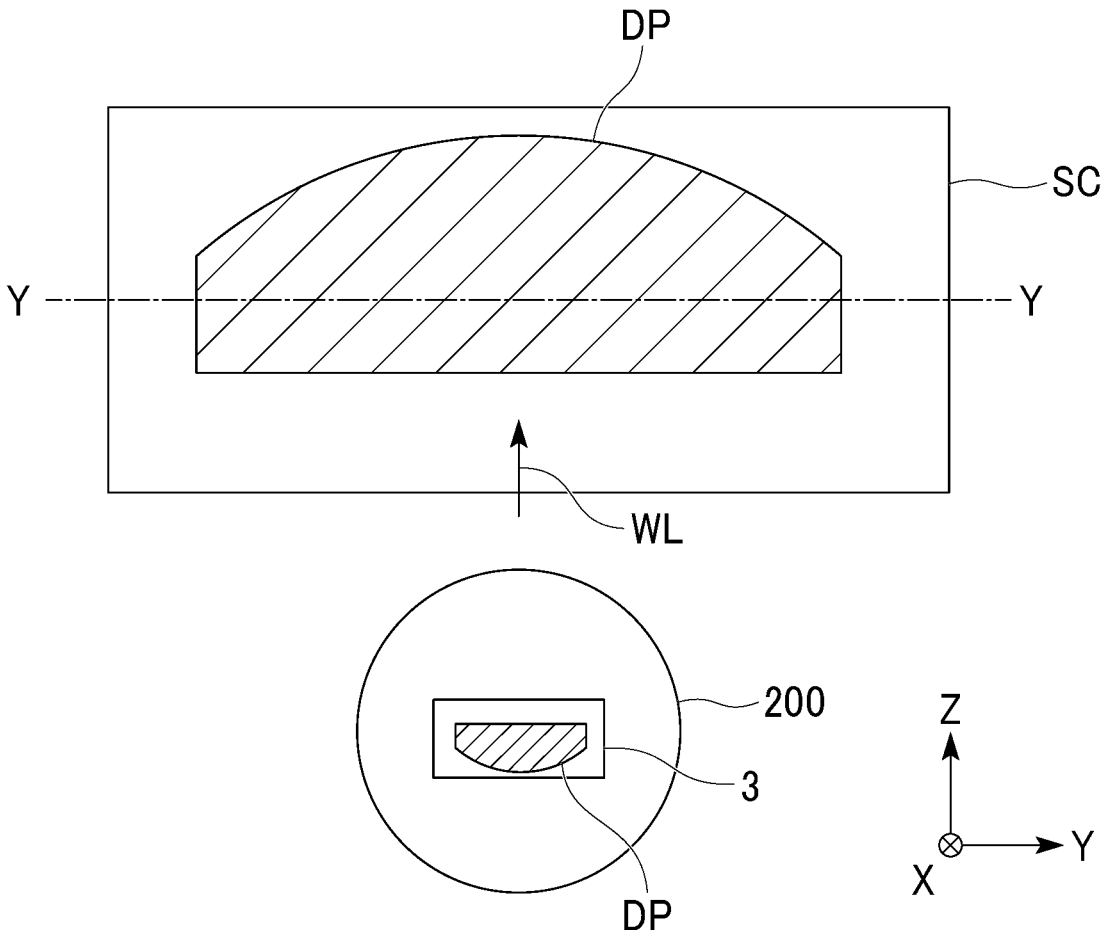
FIG. 16 is a schematic diagram showing a state in which a light source image of a light distribution pattern formed in the surface of the wavelength conversion member is projected to a virtual vertical screen facing the lighting device.

In the examples, as shown in FIG. 16, simulation of radiating the illumination light WL toward the side in front of the lighting device using the projection lens 200 and projecting a light source image of a light distribution pattern DP formed in the surface of the wavelength conversion member 3 to a virtual vertical screen SC facing the lighting device was performed using lighting devices of Examples 1-1 and 1-2, Examples 2-1 and 2-2, Examples 3-1 and 3-2, and Examples 4-1 and 4-2.

Figure 17:
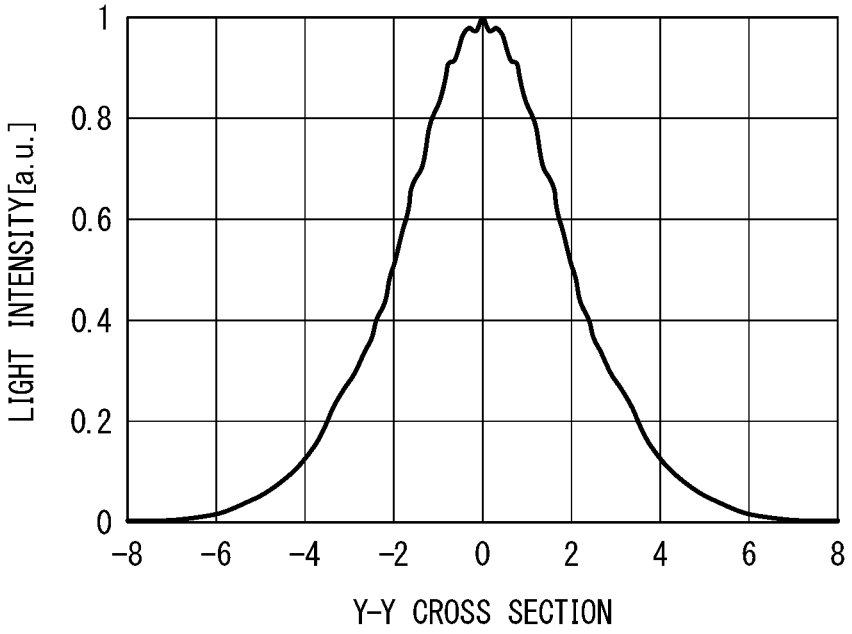
FIG. 17 is a graph showing a light intensity distribution in a cross section of a light distribution pattern along a line segment Y-Y shown in FIG. 16.

In addition, in a cross section of the light distribution pattern DP along a line segment Y-Y shown in FIG. 16 (in a cross section along a longitudinal direction of the light distribution pattern DP), the illumination light WL radiated from each of the lighting devices was adjusted to satisfy a light intensity distribution of a light distribution pattern for a high beam as shown in FIG. 17.

Examples 1-1 and 1-2

In Example 1-1, a transmission type lighting device corresponding to the lighting device 1D was used. In addition, among the laser beam scanning mechanisms 4A, 4B and 4C on the left side, the right side and the upper side, the left side is referred to as "MEMS 1," the right side is referred to as "MEMS 2," the upper side is referred to as "MEMS 3," the scanning ranges S1 to S3 of the laser beams BL1 to BL3 by these three of MEMS 1 to MEMS 3 and the centers P1 to P3 thereof were adjusted as shown in the following Table 1, and the light distribution pattern DP that satisfies the light intensity distribution of the light distribution pattern for a high beam as shown in FIG. 17 was formed by overlapping the light distribution patterns according to the scanning ranges S1 to S3 of each of the laser beams BL1 to BL3.

TABLE 1

| | MEMS 1 | MEMS 2 | MEMS 3 |
|---|---|---|---|
| Center of scanning range [mm] | 2.24 | −2.24 | 0 |
| Scanning width [mm] | 11.52 | 11.52 | 4.32 |

Further, in Table 1, in the centers P1 to P3 of the scanning ranges S1 to S3, the center O of the laser beam irradiation region E on the horizontal line HL is set as 0 [mm], the left side with respect to the center O of the laser beam irradiation region E is represented as a negative (−) side, and the right side is represented as a positive (+) side. In addition, the scanning ranges S1 to S3 are scanning widths on the horizontal line HL. In addition, Table 2 to Table 8 as described below are represented similarly.

Meanwhile, in Example 1-2, in the lighting device of Example 1-1, the light distribution pattern DP that satisfies the light intensity distribution of the light distribution pattern for a high beam as shown in FIG. 17 was formed by adjusting the scanning ranges S1 to S3 of the laser beams BL1 to BL3 by the three of MEMS 1 to MEMS 3 and the centers P1 to P3 thereof as represented in Table 2 and by overlapping the light distribution patterns according to the scanning ranges S1 to S3 of each of the laser beams BL1 to BL3.

That is, in comparison with Example 1-1, the Example 1-2 is a case in which each of the centers P1 to P3 of the scanning ranges S1 to S3 of the laser beams BL1 to BL3 by the MEMS 1 to MEMS 3 are made to match with the center O of the laser beam irradiation region E.

TABLE 2

| | MEMS 1 | MEMS 2 | MEMS 3 |
|---|---|---|---|
| Center of scanning range [mm] | 0 | 0 | 0 |
| Scanning width [mm] | 8 | 4.32 | 16 |

Examples 2-1 and 2-2

In Example 2-1, a reflection type lighting device corresponding to the lighting device 1D was used. In addition, the light distribution pattern DP that satisfies the light intensity distribution of the light distribution pattern for a high beam as shown in FIG. 17 was formed by adjusting the scanning ranges S1 to S3 of the laser beams BL1 to BL3 by the three of MEMS 1 to MEMS 3 and the centers P1 to P3 thereof as represented in the following Table 3 and by overlapping the light distribution pattern according to the scanning ranges S1 to S3 of each of the laser beams BL1 to BL3.

TABLE 3

| | MEMS 1 | MEMS 2 | MEMS 3 |
|---|---|---|---|
| Center of scanning range [mm] | 2.24 | −2.24 | 0 |
| Scanning width [mm] | 11.52 | 11.52 | 4.32 |

Meanwhile, in Example 2-2, in the lighting device of Example 2-1, the light distribution pattern DP that satisfies the light intensity distribution of the light distribution pattern for a high beam as shown in FIG. 17 was formed by adjusting the scanning ranges S1 to S3 of the laser beams BL1 to BL3 by the three of MEMS 1 to MEMS 3 and the centers P1 to P3 thereof as shown in the following Table 4, and by overlapping the light distribution patterns according to the scanning ranges S1 to S3 of each of the laser beams BL1 to BL3.

That is, in comparison with Example 2-1, the Example 2-2 is a case in which each of the centers P1 to P3 of the scanning ranges S1 to S3 of the laser beams BL1 to BL3 by the MEMS 1 to MEMS 3 are made to match with the center O of the laser beam irradiation region E.

TABLE 4

| | MEMS 1 | MEMS 2 | MEMS 3 |
|---|---|---|---|
| Center of scanning range [mm] | 0 | 0 | 0 |
| Scanning width [mm] | 8 | 4.32 | 16 |

Examples 3-1 and 3-2

In Example 3-1, the transmission type lighting device corresponding to the lighting device 1F was used. In addition, in the laser beam scanning mechanisms 4A, 4B, 4C and 4D on the left side, the right side, the upper side and the lower side, the left side is referred to as "MEMS 1," the right side is referred to as "MEMS 2," the upper side is referred to as "MEMS 3," and the lower side is referred to as "MEMS 4," and the light distribution pattern DP that satisfies the light intensity distribution of the light distribution pattern for a high beam as shown in FIG. 17 was formed by adjusting the scanning ranges S1 to S4 of the laser beams BL1 to BL4 by these four of MEMS 1 to MEMS 4 and the centers P1 to P4 thereof as shown in the following Table 5, and by overlapping the light distribution patterns according to the scanning ranges S1 to S4 of each of the laser beams BL1 to BL4.

TABLE 5

| | MEMS 1 | MEMS 2 | MEMS 3 | MEMS 4 |
|---|---|---|---|---|
| Center of scanning range [mm] | 0.68 | −0.68 | 2.08 | −2.08 |
| Scanning width [mm] | 4.56 | 4.56 | 11.84 | 11.84 |

Meanwhile, in Example 3-2, in the lighting device of Example 3-1, the light distribution pattern DP that satisfies the light intensity distribution of the light distribution pattern for a high beam as shown in FIG. 17 was formed by adjusting the scanning ranges S1 to S4 of the laser beams BL1 to BL4 by the four of MEMS 1 to MEMS 4 and the centers P1 to P4 thereof as shown in the following Table 6, and by overlapping the light distribution patterns according to the scanning ranges S1 to S4 of each of the laser beams BL1 to BL4.

That is, in comparison with Example 3-1, Example 3-2 is a case in which each of the centers P1 to P4 of the scanning ranges S1 to S4 of the laser beams BL1 to BL4 by the MEMS 1 to MEMS 4 is made to match with the center O of the laser beam irradiation region E.

TABLE 6

| | MEMS 1 | MEMS 2 | MEMS 3 | MEMS 4 |
|---|---|---|---|---|
| Center of scanning range [mm] | 0 | 0 | 0 | 0 |
| Scanning width [mm] | 3.68 | 5.76 | 8.48 | 16 |

Examples 4-1 and 4-2

In Example 4-1, the reflection type lighting device corresponding to the lighting device 1F was used. In addition, the light distribution pattern DP that satisfies the light intensity distribution of the light distribution pattern for a high beam as shown in FIG. 17 was formed by adjusting the scanning ranges S1 to S4 of the laser beams BL1 to BL4 by the four of MEMS 1 to MEMS 4 and the centers P1 to P4 thereof as shown in the following Table 7, and by overlapping the light distribution patterns according to the scanning ranges S1 to S4 of the laser beams BL1 to BL4.

TABLE 7

| | MEMS 1 | MEMS 2 | MEMS 3 | MEMS 4 |
|---|---|---|---|---|
| Center of scanning range [mm] | 0.68 | −0.68 | 2.08 | −2.08 |
| Scanning width [mm] | 4.56 | 4.56 | 11.84 | 11.84 |

Meanwhile, in Example 4-2, in the lighting device of Example 4-1, the light distribution pattern DP that satisfies the light intensity distribution of the light distribution pattern for a high beam as shown in FIG. 17 was formed by adjusting the scanning ranges S1 to S4 of the laser beams BL1 to BL4 by the four of MEMS 1 to MEMS 4 and the centers P1 to P4 thereof as shown by the following Table 8, and by overlapping the light distribution patterns according to the scanning ranges S1 to S4 of each of the laser beams BL1 to BL4.

That is, in comparison with Example 4-1, Example 4-2 is a case in which each of the centers P1 to P4 of the scanning ranges S1 to S4 of the laser beams BL1 to BL4 by MEMS 1 to MEMS 4 is made to match with the center O of the laser beam irradiation region E.

TABLE 8

| | MEMS 1 | MEMS 2 | MEMS 3 | MEMS 4 |
|---|---|---|---|---|
| Center of scanning range [mm] | 0 | 0 | 0 | 0 |
| Scanning width [mm] | 3.68 | 5.76 | 8.48 | 16 |

In the example, in the above-mentioned lighting devices of Examples 1-1 and 1-2, Examples 2-1 and 2-2, Examples 3-1 and 3-2, and Examples 4-1 and 4-2, incidence angles [° ] of the laser beams BL1 to BL3 (BL4) entering the center O of the laser beam irradiation region E from each of the MEMS 1 to MEMS 3 (MEMS 4) were calculated, and a maximum value (MAX) of the incidence angles was obtained. The results are collectively represented in the following Table 9 below.

TABLE 9

| | | Incident angle of laser beam BL1 to center O of region E from MEMS 1 [°] | Incident angle of laser beam BL2 to center O of region E from MEMS 2 [°] | Incident angle of laser beam BL3 to center O of region E from MEMS 3 [°] | Incident angle of laser beam BL4 to center O of region E from MEMS 4 [°] | Incident angle (MAX) [°] |
|---|---|---|---|---|---|---|
| Transmission type 3 MEMS | Example 1-1 | 57.68 | 57.68 | 54.16 | — | 57.68 |
| | Example 1-2 | 58.69 | 54.55 | 54.16 | — | 58.69 |
| Reflection type 3 MEMS | Example 2-1 | 57.68 | 57.68 | 54.16 | — | 57.68 |
| | Example 2-2 | 58.69 | 54.55 | 54.16 | — | 58.69 |
| Transmission type 4 MEMS | Example 3-1 | 53.14 | 53.14 | 53.88 | 53.88 | 53.88 |
| | Example 3-2 | 53.73 | 56.26 | 54.16 | 54.16 | 56.26 |
| Reflection type 4 MEMS | Example 4-1 | 53.14 | 53.14 | 53.88 | 53.88 | 53.88 |
| | Example 4-2 | 53.73 | 56.26 | 54.16 | 54.16 | 56.26 |

In addition, in the example, in the above-mentioned lighting devices of Examples 1-1 and 1-2, Examples 2-1 and 2-2, Examples 3-1 and 3-2, and Examples 4-1 and 4-2, spot sizes of the laser beams BL1 to BL3 (BL4) entering the center O of the laser beam irradiation region E from each of the MEMS 1 to MEMS 3 (MEMS 4) were calculated, a ratio with respect to the spot size when an incidence angle is 0° (incidence ratio) was obtained, and further, a maximum value (MAX) thereof was obtained. The results are collectively represented in the following Table 10.

TABLE 10

| | | Spot size of laser beam BL1 to center O of region E from MEMS 1 [0° Incident ratio] | Spot size of laser beam BL2 to center O of region E from MEMS 2 [0° Incident ratio] | Spot size of laser beam BL3 to center O of region E from MEMS 3 [0° Incident ratio] | Spot size of laser beam BL4 to center O of region E from MEMS 4 [0° Incident ratio] | Spot size (MAX) [0° Incident ratio] |
|---|---|---|---|---|---|---|
| Transmission type 3 MEMS | Example 1-1 | 1.87 | 1.87 | 1.71 | — | 1.87 |
| | Example 1-2 | 1.92 | 1.72 | 1.71 | — | 1.92 |
| Reflection type 3 MEMS | Example 2-1 | 1.87 | 1.87 | 1.71 | — | 1.87 |
| | Example 2-2 | 1.92 | 1.72 | 1.71 | — | 1.92 |
| Transmission type 4 MEMS | Example 3-1 | 1.67 | 1.67 | 1.70 | 1.70 | 1.70 |
| | Example 3-2 | 1.69 | 1.80 | 1.71 | 1.71 | 1.80 |
| Reflection type 4 MEMS | Example 4-1 | 1.67 | 1.67 | 1.70 | 1.70 | 1.70 |
| | Example 4-2 | 1.69 | 1.80 | 1.71 | 1.71 | 1.80 |

As represented in Table 9 and Table 10, in the lighting devices of Examples 1-1, 2-1, 3-1 and 4-1, in comparison with the lighting devices of Examples 1-2, 2-2, 3-2 and 4-2, it is possible to reduce the incidence angles and the spot sizes of the laser beams BL1 to BL3 (BL4) entering the center O of the laser beam irradiation region E from each of the MEMS 1 to MEMS 3 (MEMS 4).

Further, the present invention is not particularly limited to the embodiments, and various modifications may be made without departing from the scope of the present invention.

Specifically, in the lighting devices 1A to 1F, when the wavelength conversion members 3A and 3B are damaged, chipped or fallen off, since it is set to an angle where the laser beam BL does not directly enter the projection lens 200, a light absorbing section or a light shielding section configured to absorb or shield the laser beam BL scanned by the laser beam scanning mechanism 4 is preferably provided inside the lighting body. As the light absorbing section or the light shielding section, a configuration in which a light absorbing member or a light shielding member configured to absorb or shield the laser beam BL is disposed may be provided.

The wavelength conversion members 3A and 3B are not particularly limited to the above-mentioned embodiments, and configurations, materials, or the like, thereof may be appropriately selected and used.

For example, [1] as the wavelength conversion members 3A and 3B, a member obtained by joining or attaching a molded body of a phosphor plate to a substrate, or [2] a member obtained by forming a phosphor layer (wavelength conversion layer) on a substrate may be used.

In addition, in the case of the transmission type wavelength conversion member 3A, a transparent substrate such as a transparent ceramic substrate, a glass substrate, or the like, may be used. Meanwhile, in the case of the reflection type wavelength conversion member 3B, a reflection substrate obtained by forming a reflection film on a surface such as a ceramic substrate, a glass substrate, or the like, in addition to a metal substrate, may be used.

In the case of the above-mentioned [1], for example, a single crystal phosphor sheet, a phosphor ceramic sheet, a phosphor-dispersed glass sheet, a phosphor-dispersed resin sheet, or the like, may be used. In addition, as an adhesive agent, for example, a transparent adhesive agent such as an organic-based adhesive agent, an inorganic-based adhesive agent, or the like, is used.

Meanwhile, in the case of the above-mentioned [2], for example, a ceramic binder, a glass binder, or a resin binder in which phosphor particles are dispersed can be coated on a substrate using a dispense method, a rotary coating method, a printing method, a spray method, or the like.

As the phosphor particles, for example, phosphor oxide, phosphor nitride, phosphor oxynitride, phosphor sulfide, phosphor fluoride, or the like, may be granulated and used. Further, a thickness of a phosphor layer or a particle diameter (D50) of phosphor particles is not particularly limited and may be arbitrarily set. In addition, a transparent protective layer may be further provided on a phosphor layer. As the transparent protective layer, for example, an inorganic substance such as glass, ceramic, or the like, a silicon resin, an epoxy resin, or the like, may be used.

The laser beam scanning mechanism 4 may use a MEMS mirror of a piezoelectric type, an electrostatic type or an electromagnetic type. In addition, the MEMS mirror may use a biaxial type or two single axis types because the laser beam BL is scanned in the surfaces of the wavelength conversion members 3A and 3B.

In addition, as a biaxial type of a piezoelectric type, a single axis resonance/single axis non-resonance type, a biaxial resonance type, a biaxial non-resonance type, or the like, is exemplified. Further, in the case of the single axis resonance/single axis non-resonance type, a non-resonance axis and a resonance axis may be assigned to any one of an X axis and a Y axis in the surfaces of the wavelength conversion members 3A and 3B.

The reflector 5 is not limited to the above-mentioned planar mirror, and a curved mirror configured to correct distortion of the laser beam BL reflected toward the wavelength conversion members 3A and 3B may be used. In addition, a lens configured to correct distortion may also be disposed between the reflector 5 and the wavelength conversion members 3A and 3B.

The projection lens 200 is not limited to a single lens, and a combination of a plurality of lens (group lens) may also be used. In addition, the lens is not limited to a spherical type, and a non-spherical type may also be used.

In addition, the lighting device to which the present invention is applied is appropriately used for the above-mentioned vehicle lamp fixture, and may be widely applied to other uses than the vehicle lamp fixture.

REFERENCE SIGNS LIST

1A to 1F Lighting device
2, 2A, 2B, 2C, 2D Laser light source
3, 3A, 3B Wavelength conversion member
4, 4A, 4B, 4C, 4D Laser beam scanning mechanism
5 Reflector
6 Reflection plate
100 Vehicle lamp fixture
200 Projection lens
BL Laser beam
YL Fluorescent light
WL Illumination light
E Laser beam irradiation region
O Center of laser beam irradiation region
S, S1, S2, S3, S4 Scanning range of laser beam
P, P1, P2, P3, P4 Center of scanning range of laser beam
Q1, Q2 Center of laser scanning mechanism
VL Vertical line
HL Horizontal line

The invention claimed is:

1. A lighting device comprising:

a laser light source configured to emit a laser beam;

a wavelength conversion member that includes a laser beam irradiation region to which the laser beam is radiated and that is configured to emit a wavelength converted light excited by radiation of the laser beam;

a laser beam scanning mechanism configured to form a light distribution pattern according to a scanning range of the laser beam by scanning the laser beam radiated to the laser beam irradiation region; and a projection lens configured to project illumination light that forms the light distribution pattern forward, wherein an incidence angle of the laser beam, which is scanned by the laser beam scanning mechanism, with respect to the wavelength conversion member is set to an angle where the laser beam does not directly enter the projection lens when the wavelength conversion member is damaged, chipped or fallen off.

2. The lighting device according to claim 1, wherein, when the wavelength conversion member is seen in a plan view, a center of a scanning range of the laser beam is located at a side opposite to a side where the laser beam scanning mechanism is disposed with respect to a center of the laser beam irradiation region.

3. The lighting device according to claim 2, wherein the laser light source and the laser scanning mechanism are disposed on one side and other side with respect to the wavelength conversion member, respectively, the laser beam scanning mechanism disposed on the one side forms a light distribution pattern according to a scanning range of one laser beam by scanning the one laser beam radiated toward the laser beam irradiation region from the laser light source disposed on the one side, the laser beam scanning mechanism disposed on the other side forms a light distribution pattern according to a scanning range of other laser beam by scanning the other laser beam radiated toward the laser beam irradiation region from the laser light source disposed on the other side, one synthesis light distribution pattern is formed by overlapping the light distribution pattern according to the scanning range of the one laser beam and the light distribution pattern according to the scanning range of the other laser beam, and wherein, when the wavelength conversion member is seen in a plan view, a center of scanning range of the one laser beam is located at a side opposite to a side where the laser beam scanning mechanism on the one side is disposed with respect to the center of the laser beam irradiation region, and a center of the scanning range of the other laser beam is located at a side opposite to a side where the laser beam scanning mechanism on the other side is disposed with respect to the center of the laser beam irradiation region.

4. The lighting device according to claim 3, wherein the one side is a position corresponding to a left side of the light distribution pattern, and the other side is a position corresponding to a right side of the light distribution pattern.

5. The lighting device according to claim 4, wherein, when the wavelength conversion member is seen in a plan view, a width of the laser beam irradiation region, which corresponds to a leftward/rightward direction of the light distribution pattern, is greater than a height of the laser beam irradiation region, which corresponds to an upward/downward direction of the light distribution pattern.

6. The lighting device according to claim 5, wherein the laser light source and the laser scanning mechanism are additionally disposed at positions corresponding to an upper side or a lower side of the light distribution pattern with respect to the wavelength conversion member, or disposed at positions corresponding to the upper side and the lower side of the light distribution pattern with respect to the wavelength conversion member, the laser beam scanning mechanism disposed on an additional side forms a light distribution pattern according to a scanning range of an added laser beam radiated toward the laser beam irradiation region from the laser light source disposed on the additional side by scanning the added laser beam, and one synthesis light distribution pattern is formed by overlapping the light distribution pattern according to the scanning range of the one laser beam, the light distribution pattern according to the scanning range of the other laser beam, and the light distribution pattern according to the scanning range of the added laser beam.

7. The lighting device according to claim 6, wherein, when the wavelength conversion member is seen in a plan view, a center of a scanning range of the added laser beam is located at an intersection between a vertical line corresponding to the upward/downward direction of the light distribution pattern passing through a center of the laser beam scanning mechanism on the additional side and a horizontal line corresponding to the leftward/rightward direction of the light distribution pattern which passes through the center of the laser beam irradiation region.

8. The lighting device according to claim 6, wherein the laser scanning mechanism disposed on the additional side is disposed to be deviated to either one of the one side corresponding to the left side of the light distribution pattern and the other side corresponding to the right side of the light distribution pattern.

9. A vehicle lamp fixture comprising the lighting device according to claim 1.

* * * * *